US007229309B2

(12) United States Patent
Carroll et al.

(10) Patent No.: US 7,229,309 B2
(45) Date of Patent: Jun. 12, 2007

(54) NETWORK CONNECTION SYSTEM

(75) Inventors: James A. Carroll, 8210 W. 109th St., Bloomington, MN (US) 55438; Thomas R. Finke, Wayzata, MN (US)

(73) Assignee: James A. Carroll, Bloomington, MN (US)

( * ) Notice: Subject to any disclaimer, the term of this patent is extended or adjusted under 35 U.S.C. 154(b) by 0 days.

(21) Appl. No.: 11/159,695

(22) Filed: Jun. 23, 2005

(65) Prior Publication Data

US 2005/0287873 A1 Dec. 29, 2005

Related U.S. Application Data

(60) Provisional application No. 60/582,404, filed on Jun. 24, 2004.

(51) Int. Cl.
*H01R 4/24* (2006.01)

(52) U.S. Cl. ..... 439/418; 439/460; 439/941

(58) Field of Classification Search ..... 439/418, 439/941, 460

See application file for complete search history.

(56) References Cited

U.S. PATENT DOCUMENTS

| | | | | |
|---|---|---|---|---|
| 4,101,114 | A | 7/1978 | Martin et al. | |
| 4,171,123 | A | 10/1979 | Woelkers | |
| 4,684,161 | A | 8/1987 | Egner et al. | |
| 4,731,663 | A | 3/1988 | Kovalchick et al. | |
| 5,009,612 | A | 4/1991 | Rishworth et al. | |
| 5,226,835 | A * | 7/1993 | Baker et al. | 439/403 |
| 5,403,200 | A | 4/1995 | Chen | |
| 5,409,397 | A | 4/1995 | Karman | |
| 5,431,370 | A | 7/1995 | Verkuylen et al. | |
| 5,480,203 | A | 1/1996 | Favalora et al. | |
| 5,498,172 | A | 3/1996 | Noda | |
| 5,505,432 | A | 4/1996 | Noonan | |
| 5,538,438 | A | 7/1996 | Orlando | |
| 5,601,447 | A | 2/1997 | Reed et al. | |
| 5,830,005 | A | 11/1998 | Watanabe | |

(Continued)

FOREIGN PATENT DOCUMENTS

JP 20117317 U1 12/2001

OTHER PUBLICATIONS

"*Zone Cabling: Blending An Old Idea With New Technology*"; John C. Leavitt, Nilgun A. Leavilt, Altug Consulting Engineers, and Adrian Zvarych; Jul. 6, 2000.

(Continued)

*Primary Examiner*—James R. Harvey
(74) *Attorney, Agent, or Firm*—Patterson, Thuente, Skaar & Christensen, P.A.

(57) ABSTRACT

A network connection system for connecting computer network components, the network connection system including a twisted pair cable having multiple conductors in twisted pairs a cable termination connector affixable at an end of the cable. The cable termination connector includes a slender elongate connector housing; and termination contacts located within the connector housing. The termination contacts include a conductor engaging portion, optionally, an RJ connector engaging portion and a male contact portion releasably engageable to a female gripping contact. The network connection system also includes connecting hardware as well as a dust cover, a pull ring cover and a feeder strip. The present invention can be used on a local area network (LAN) or a wide area network (WAN).

20 Claims, 27 Drawing Sheets

U.S. PATENT DOCUMENTS

| | | | | |
|---|---|---|---|---|
| 5,911,594 | A | 6/1999 | Baker, III et al. | |
| 5,938,181 | A | 8/1999 | Holden | |
| 5,961,354 | A | 10/1999 | Hashim | |
| 5,996,224 | A | 12/1999 | Sullivan | |
| 6,019,641 | A | 2/2000 | Kan | |
| 6,080,007 | A | 6/2000 | Dupuis et al. | |
| 6,193,542 | B1 | 2/2001 | Marowsky et al. | |
| 6,244,906 | B1 | 6/2001 | Hashim et al. | |
| 6,276,943 | B1 | 8/2001 | Boutros et al. | |
| 6,280,232 | B1 | 8/2001 | Beecher et al. | |
| 6,328,610 | B1 | 12/2001 | Chang | |
| 6,332,802 | B2 | 12/2001 | Hirokawa | |
| 6,370,769 | B1 | 4/2002 | Lilienthal, II | |
| 6,375,491 | B1 * | 4/2002 | Durand et al. | 439/418 |
| 6,379,174 | B1 * | 4/2002 | Siemon et al. | 439/404 |
| 6,396,993 | B1 * | 5/2002 | Giebel et al. | 385/136 |
| 6,398,591 | B1 | 6/2002 | Hess et al. | |
| 6,402,545 | B1 | 6/2002 | Huang | |
| 6,402,559 | B1 | 6/2002 | Marowsky et al. | |
| 6,406,325 | B1 | 6/2002 | Chen | |
| 6,409,535 | B1 | 6/2002 | Marowsky et al. | |
| 6,409,539 | B1 | 6/2002 | Shi et al. | |
| 6,409,548 | B1 | 6/2002 | Guttierez | |
| 6,409,549 | B1 | 6/2002 | Yeh | |
| 6,431,918 | B1 | 8/2002 | Givens et al. | |
| 6,508,677 | B1 | 1/2003 | Wang | |
| 6,517,386 | B2 | 2/2003 | Sakakura et al. | |
| 6,729,901 | B2 | 5/2004 | Aekins | |
| 7,014,495 | B2 * | 3/2006 | Carroll | 439/404 |
| 7,017,267 | B2 * | 3/2006 | Carroll | 29/866 |

OTHER PUBLICATIONS

American Access Technologies, Inc., brochure, pp. 1-12, Date Unknown.

Hitachi Cable Manchester, Inc., *Balanced Twisted-Pair Copper Cable*, Brochure, pp. 1-6, Copyrighted Oct. 2001.

* cited by examiner 368
370
102
372
366
374
364
376

368
372
366
102
364
376

102
364

320
320
354
352
350
312

320
320
354
322
322
352
350
312

NETWORK CONNECTION SYSTEM

CLAIM TO PRIORITY

This application claims priority to U.S. Provisional Application Ser. No. 60/582,404 filed Jun. 24, 2004 entitled "Twisted Pair Connection System and Method which is incorporated herein in its entirety by reference.

FIELD OF THE INVENTION

The invention generally relates to connectors for wiring computer and telephone networks. More particularly, the invention relates to connectors for termination twisted pair cables.

BACKGROUND OF THE INVENTION

Twisted pair cables are commonly used for the wiring of computer and telephone networks. Twisted pair wire orientation is governed by EIA/TIA Standard 568B and industry connection methods Conventional twisted pair cable includes four twisted pair conductors inside an outer insulation jacket. In some cables a plastic cross shaped extrusion resides inside the cable jacket along with the wires to separate the four pairs from each other and maintain each pair within its own quadrant within the cable jacket.

The four twisted pairs are color coded as a blue pair, a green pair, an orange pair, and a brown pair. Each pair includes two conductors a first conductor covered by solid color insulation colored to match that pair designation and a second conductor covered by white insulation with colored stripes that are the same color as the solid colored insulation twisted together. For example, the blue pair includes one wire solid blue in color and a second wire white with blue stripes. The same is true for the green, orange, and brown pairs. In the 568B standard, the color coding standardizes the position each conductor occupies when assembled into an RJ45 modular connector or modular jack.

There are 8 positions in a modular connector, one for each conductor. A prior art RJ45 plug includes a front where it mates with a jack and a rear where the cable enters as well as a locking tab. Viewing the front of the RJ45 plug, with the locking tab at the top, the eight positions are designated one through eight from left to right. Under the standard, the blue pair typically is designated Pair #1 and occupies position 4 and 5 with the solid blue conductor in position 4 and the white/blue conductor occupies position 5. The Orange pair is designated Pair #2 and occupies positions 1 and 2 with the white/orange conductor in position 1 and the Orange conductor in position 2. The green pair is designated Pair #3 and is also known as the split pair in the RJ45 assembly because it occupies positions 3 and 6 with the solid green conductor in position 6 and the white/green color conductor occupying position 3. The brown pair is designated Pair #4 and occupies positions 7 and 8. The white/brown conductor is located at position 7 and the solid brown conductor in position 8. The importance of these standardized positions will become apparent in the description of the sub components and assembly of the new connector of the present invention.

The most dominant interface for connecting 4 pair twisted pair cable in the market at the time of this application is the RJ45 connector interface as described by the FCC in 47 CFR 68 Subpart F. The FCC standard describes dimensional tolerances for the plug, port and features to assure operable compatibility between plugs and jacks made by various manufacturers.

Typically an industry standard modular jack has one port for mating with an RJ45 plug, that meets the requirements of FCC under 47 CFR 68 Subpart F and a second port that is adapted to attach twisted pair cable conductors to the jack. Generally, jacks are terminated to twisted pair cable in the field by stripping back the outer jacket, exposing the conductor pairs, and terminating these pairs to terminals on the jack. Patch cords in predetermined lengths, with RJ45 plugs assembled to each end, are available to connect hardware such as computer work stations and printers to the modular jacks and thus to the network.

In many cases, the modular connector is installed by craft personnel in the field. Problems are associated with installing jacks and plugs in the field related to inconsistency of method that occur from one installer to the next. These result is failures in data transmission and the expenditure of large amounts of time and effort to troubleshoot and repair inadequate field made connections.

One possible solution to this problem would be to pre-terminate the connection in a controlled environment and to test the connections prior to installation in the field. The obstacle to pre-terminating all connections lies in the need to feed and pull cable with plugs installed through conduit and around obstacles common in buildings being wired for networks. The design profile of the prior art RJ45 modular plug is too large to be pulled through smaller conduit channels and the features, such as the locking tab, and shape of the plugs make them prone to catch on obstacles. This leads to damage to the connectors and cable.

Thus the network wiring industry would benefit from a network wiring termination system that that would allow for pre-termination of conductors, testing of the network wiring components prior to release to field personnel and ease of pulling network wiring through conduit and past obstacles that are commonly encountered in the installation of network cabling.

SUMMARY OF THE INVENTION

The network connection system of the present invention solves many of the above-discussed problems. The network connection system of the invention includes a universal cable termination (UCT) connector and connecting hardware as well as a dust cover, a pull ring cover and a feeder strip. The present invention can be used on a local area network (LAN) or a wide area network (WAN).

The UCT connector terminates to the end of unshielded or shielded twisted pair cable and provides the point of access to a two-port jack or hardware on a network. For use with shielded cabling a shielding jacket may be added to the connector. The UCT connector has a smaller design profile than a prior art RJ45 connector and is a multifunctional connector. It can serve as a stand-alone connection interface with a mating jack interface. In addition, with the application of an adapter cover assembled to the UCT connector it can be used as a standard RJ plug that will connect to a standard RJ jack port.

The profile of the UCT connector is small and tapered so that it can easily be pulled through conduit and around obstacles. While the UCT connector can be installed in the field, it is primarily intended to be preinstalled in a controlled manufacturing environment. Preinstallation of the UCT connector assures greater repeatability of performance than application by field installers with various levels of expertise. In addition, the economics of a factory environment allow for cost savings versus field installation.

The stand-alone UCT connector interface also provides for a very repeatable connection with the mating jack port. These levels of repeatability provide for improved signature performance and a more consistent level of performance from one connection to the next in a network.

The UCT connector may be configured to have termination contacts installed in a factory-manufacturing environment. In addition the UCT connector may be configured with preloaded termination contacts. Preloaded termination contacts may be preferred for the less typical situation in which the UCT connector is field terminated.

The UCT connector may also be configured to accommodate a printed circuit incorporated into the UCT connector adapted for connection to an RJ45 jack.

The network connection system of the present invention has several advantages. In the interface between the UCT connector contact blade and the split tine contact gap there is no requirement to displace a conductor insulation jacket to achieve electrical connection between the split tine and the copper core of the cable conductors. This is a common problem in the industry where cable conductors are not fully punched down into the split tine IDC slots which makes the jack inoperable. Repairs require addition time by the craftsperson, usually after the entire link or channel is constructed, to isolate where the problem exists and then re-punch the connections until a good connection is achieved. The UCT connection uses insulation displacement type contact technology to create the physical and electrical connection between the jack and the UCT connector however without the need to pierce through an insulating jacket. When the contact blades in the UCT connector seat into the gap between the two tines of the jack contacts it creates a very high-pressure contact with natural redundancy because of the two-tine design.

Occasionally the craftsperson terminating a jack will flip or misplace a conductor pair when terminating the conductors to the jack in the field. In this case the jack is again inoperable and the problem is not found until the link or channel is tested. When the problem is found the craftsperson must isolate the connection that is incorrect and re-terminate the jack and connection. In the UCT connection interface the connector and jack mate only one way, therefore the match up of pair positions will always be constant.

The third advantage to the UCT connection has to do with the spatial orientation and configuration of the cable pairs. In typical industry standard IDC terminations, there are recommendations for managing the cable conductor pairs, however there is little or no control over the craft person's management of the conductor pair twist and spatial orientation of the conductor pairs as they are terminated to the jack IDC's. Both have impact on the signal carrying performance of the jack. A quality connection then becomes very dependent upon the craft person's skill and experience. Within the UCT connector the cable pairs and contact patterns are managed consistently from one UCT connector to the next. Therefore the connection interface becomes consistent from one jack to the next. This assures a consistent and repeatable signal carrying performance signature to the jack port interface.

DETAILED DESCRIPTION OF THE INVENTION

Figure 1:
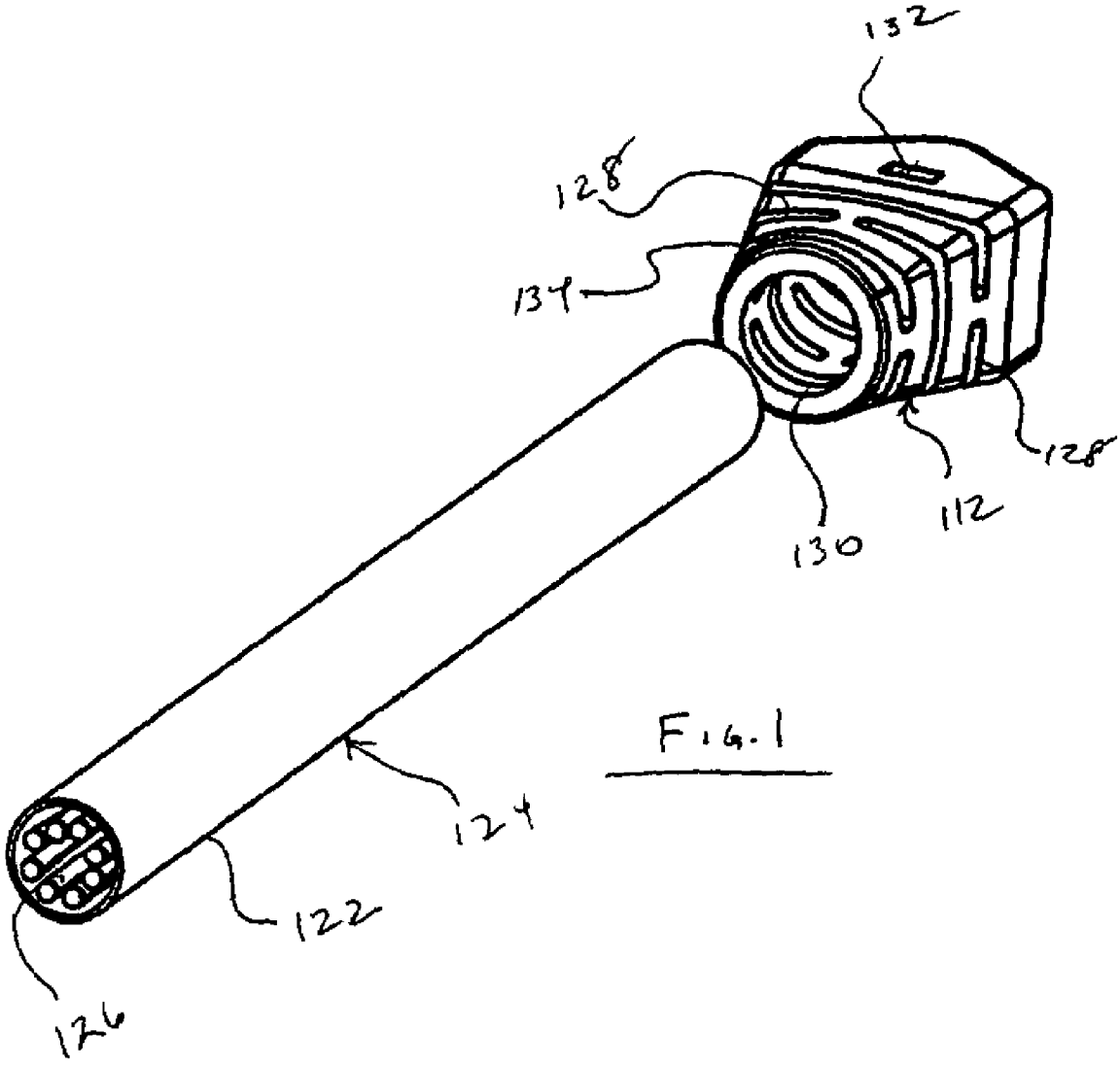
FIG. 1 is a perspective view of a twisted pair cable and strain relief in accordance with the present invention.

Referring to FIGS. 1–47, the network connection system 100 includes universal cable termination (UCT) connector 102 and connecting hardware 104 as well as a dust cover 106, a pull ring cover 108 and a feeder strip 110.

Figures 11, 12:
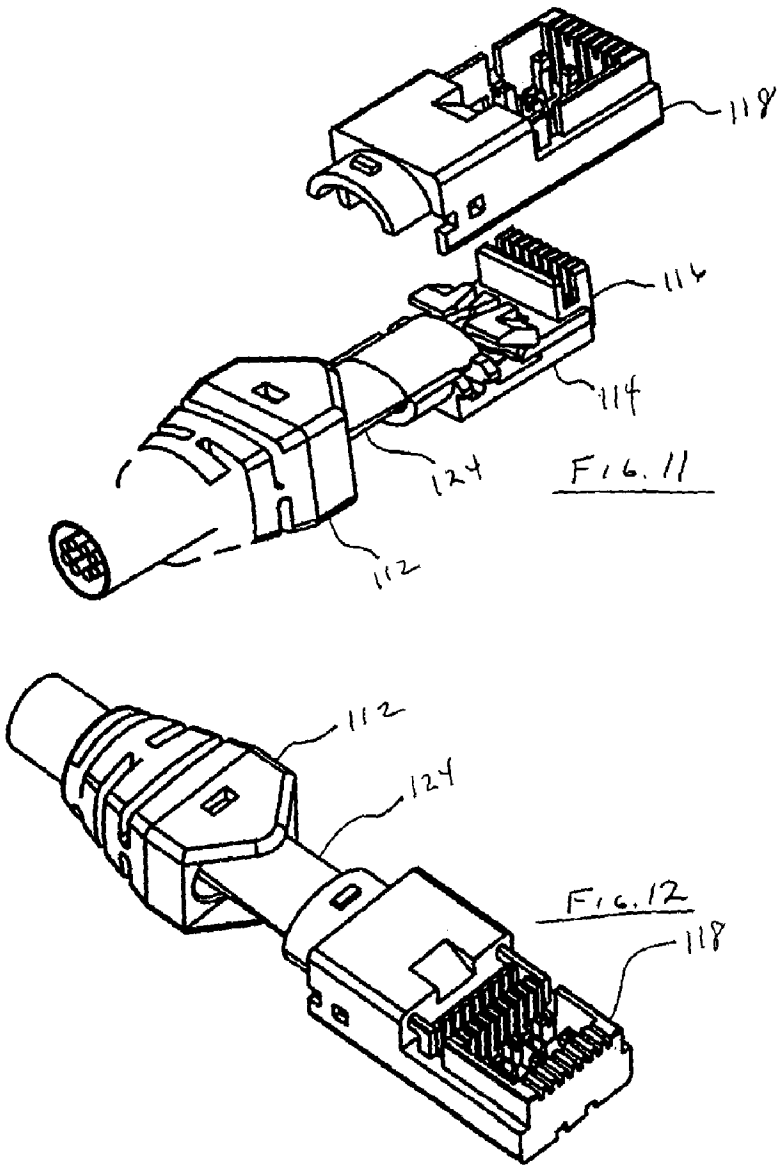
FIG. 11 is an exploded perspective view of the pair manager tray, pair manager cap, and connector housing.
FIG. 12 is an assembled perspective view of the pair manager tray, pair manager cap and connector housing.
Figure 16:
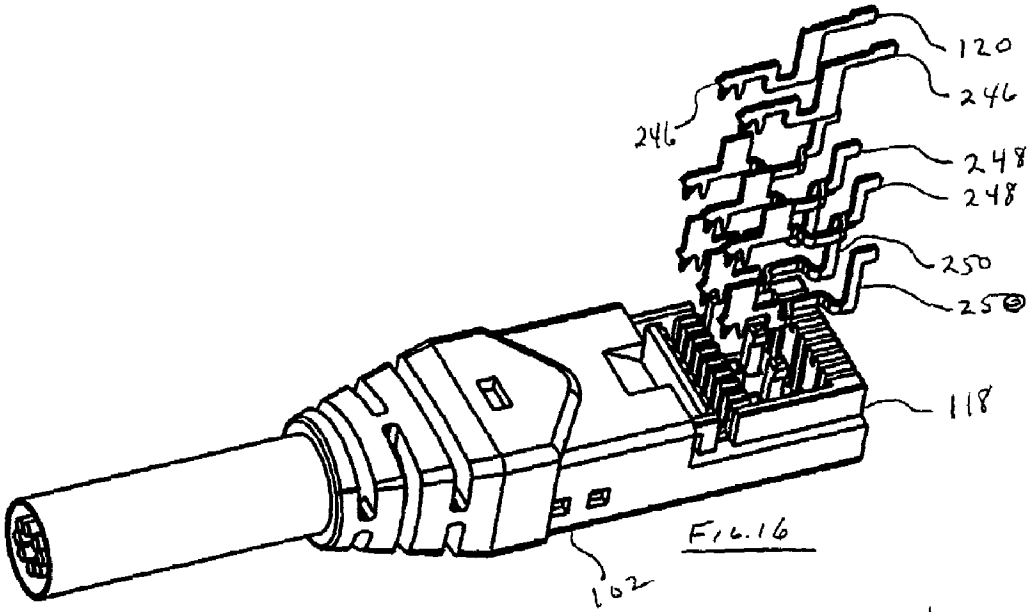
FIG. 16 is an exploded perspective view of the termination contacts and UCT connector in accordance with the present invention.
Figure 17:
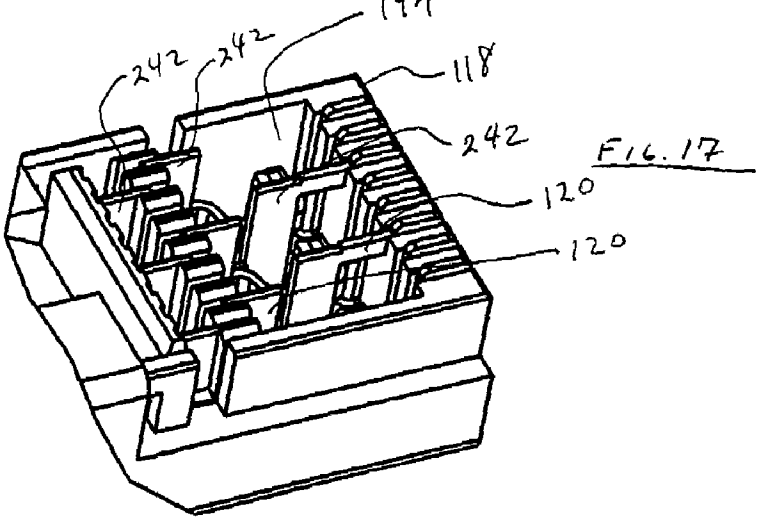
FIG. 17 is a detailed perspective view of the termination contacts as assembled in the UCT connectors.

The UCT connector 102, as depicted in FIGS. 11 and 16, generally includes strain relief boot 112, pair manager tray 114, pair manager cap 116, connector housing 118 and termination contacts 120. Two UCT connectors 102 along with an intervening cable connecting them are primarily intended as a station connector to connect from, for example, a switch panel to a jack. The jack is then connected to a peripheral such as a personal computer or a printer by a patch cable. Under applicable standards the station cable can extend up to three hundred twenty-seven feet.

Figure 2:
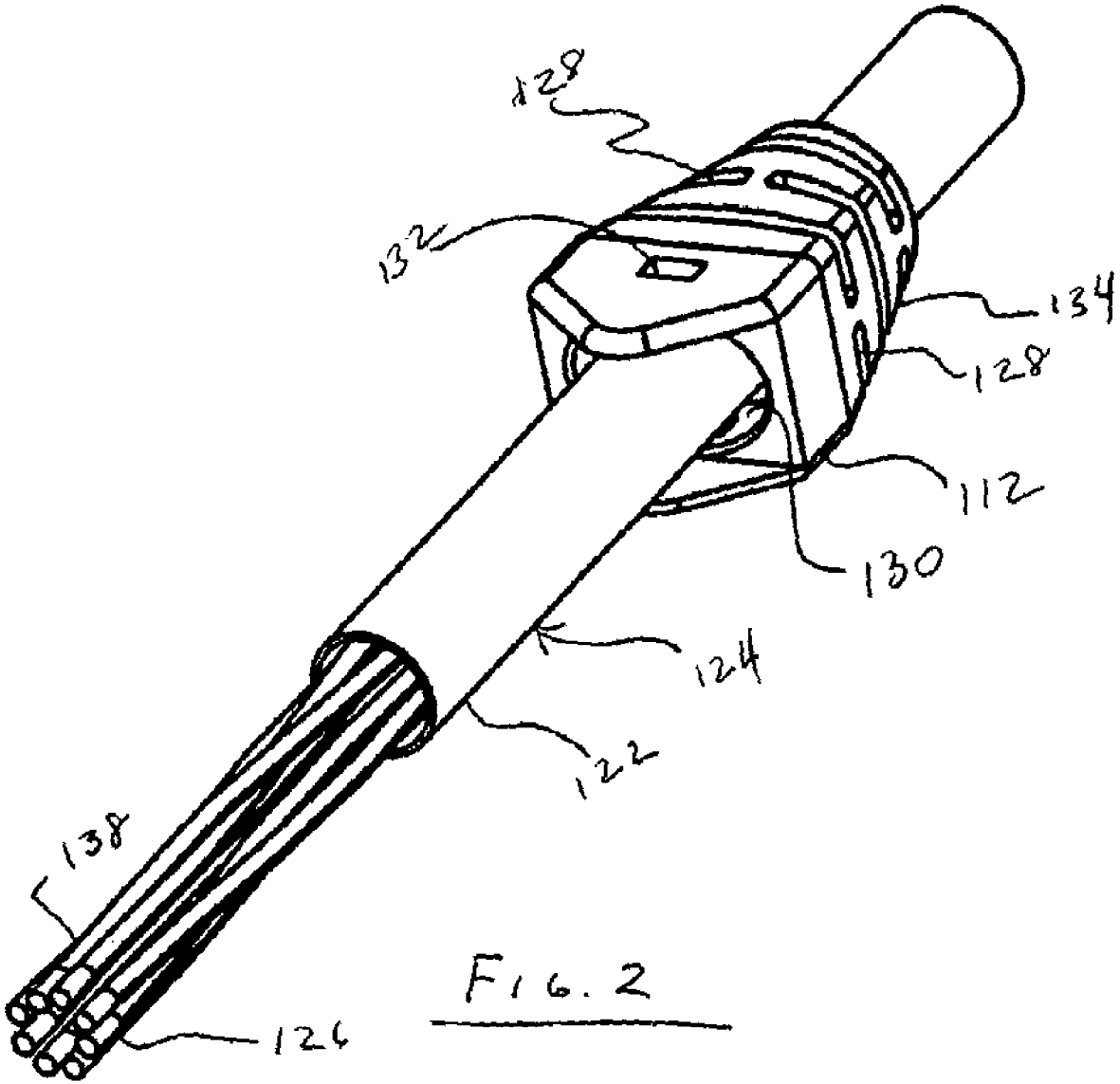
FIG. 2 is a perspective view of a twisted pair cable and strain relief in accordance with the present invention.
Figure 4:
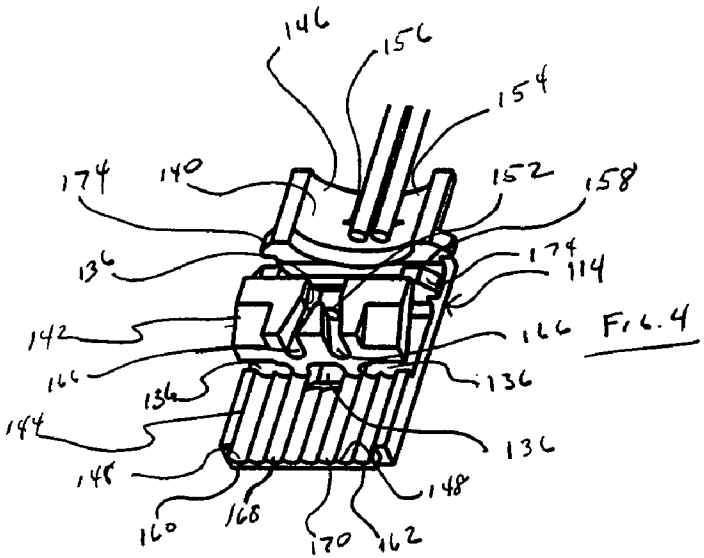
FIG. 4 is a detailed perspective view of a pair manager tray taken from FIG. 3.
Figure 3:
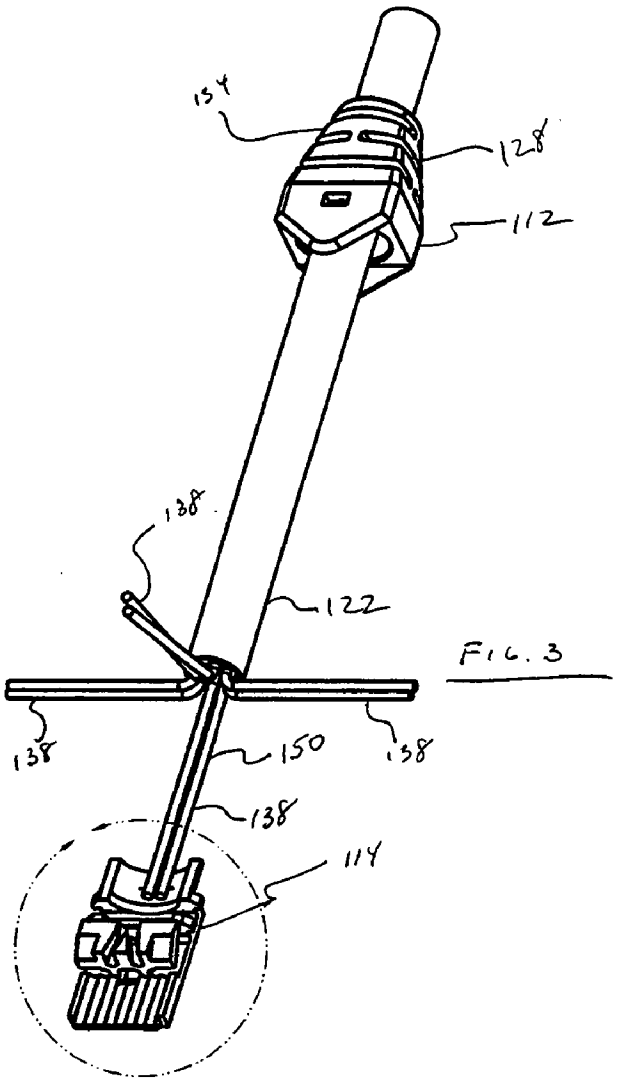
FIG. 3 is a perspective view of a strain relief twisted pair cable and pair manager tray in accordance with the present invention.
Figure 5:
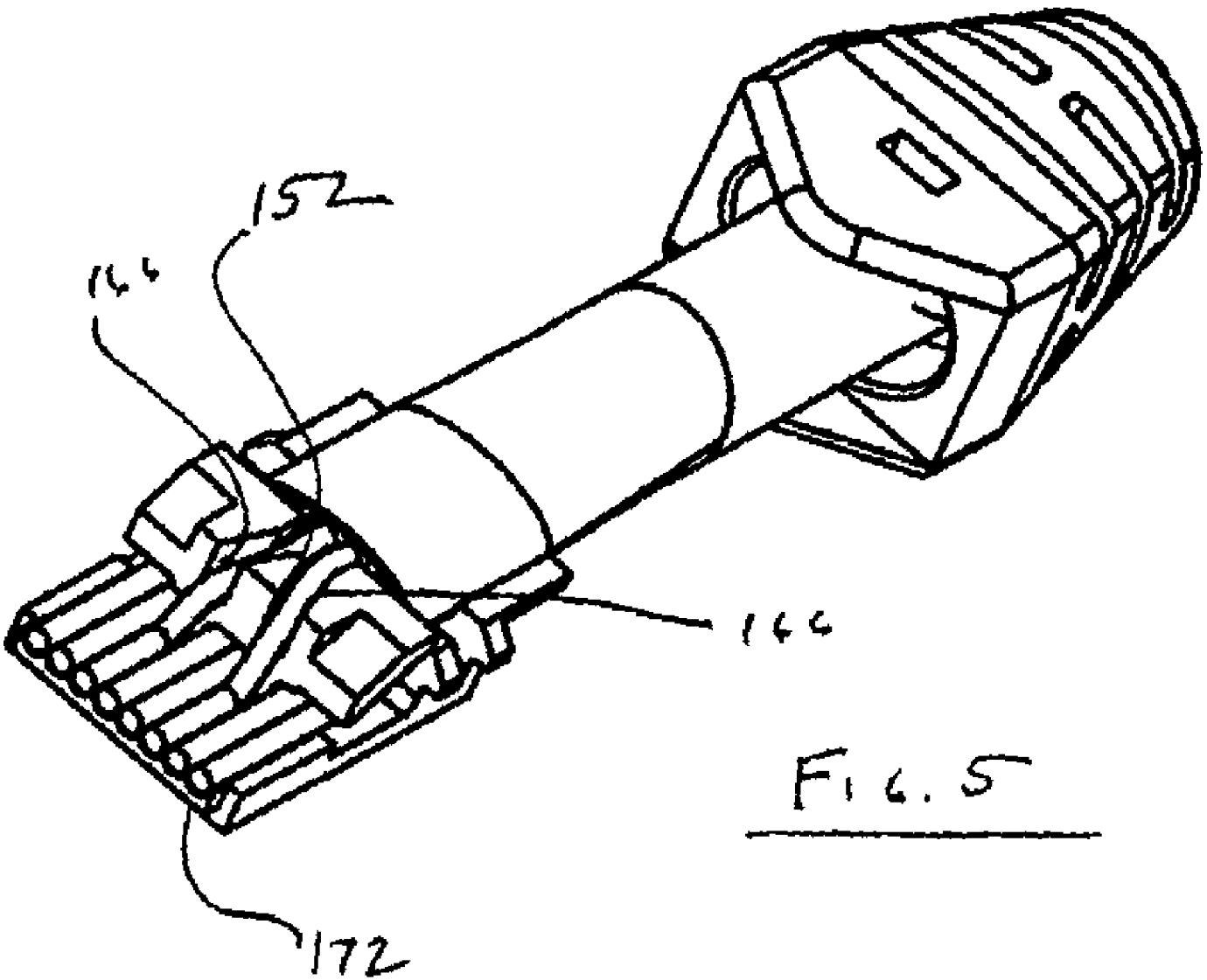
FIG. 5 is a perspective view of a fully assembled twisted pair of cable and pair manager tray in accordance with the present invention.

Referring FIGS. 1 and 2, to strain relief boot 112 is fabricated from a flexible polymer that slides with some resistance over the outer jacket 122 of cable 124 when assembled. The outer jacket 122 typically encases 4 twisted pairs including eight individually insulated conductors 126. The strain relief boot 112 adds support to cable 124 such that when a side load, out of axis to the cable 124, is applied, the cable 124 becomes slightly supported by the Strain relief boot 112 and bends through a larger radius than if the strain relief boot 112 was not in place. This increases cable 124 life and limits the performance degradation that occurs if cable 124 is bent sharply. Strain relief boot 112 defines an alternating series of partial slots 128 for controlled flexibility when cable 124 is subjected to a side load.

Strain relief boot 112 also defines transition channel 130 that envelops cable 124. From the rear, or where the cable enters, transition channel 130 is substantially circular and cylindrical and then tapers to an oval cross section. Cable 124 cross section is typically round in a free and uncompressed state. The taper from round to the oval shape creates a squeezing retentive force that secures UCT connector 102 to the cable 124.

It is within channel 130 of strain relief boot 112 that cable 124 is retained by a squeezing pressure that absorbs any pull or strain applied to the cable 124 and restricts transmission to the conductors 126 within the connector assembly. This assures a reliable and secure connection. Strain relief boot 112 presents two window slots 132.

Strain relief boot 112 presents a tapered or conical outer shape. Taper 134 when assembled as part of UCT connector 102, facilitates pulling a pre-connectorized cable through conduit or around obstacles and reduces the likelihood of the connector catching on obstructions.

Referring to FIGS. 3–8, pair manager tray 114 defines separate channels 136 to route each conductor pair 138. Pair manager tray 114 includes rear region 140 where cable 124 enters and is held by the pair manager tray 114 and connector housing 118, mid-region 142 that separates and routes cable conductor pairs 138 to front region 144. Front region 144 includes a series of troughs that the conductors 126 rest in. Orientation of pair manager tray 114 is such that the cable 124 lies in a cradle 146 in the rear region 140. Individual conductor pairs 138 rest in adjacent troughs 148 and the split pair straddles the center pair 150 over Y-passage 152. Pair manager tray 114 controls the transition and position of conductor pairs 138 as they exit beyond the jacket 122 of cable 124 to a predetermined spatial relationship with each other, in an adjacent and substantially planar orientation.

Protruding from the inside surface 154 of the cradle 146 is knife-edge blade 156 designed to bite into the outer jacket 122 of the cable 124 when assembled. It also serves to secure the UCT connector 102 to cable 124 and to resist any pulling forces that may occur. The rear region 140 also defines a channel 158 across the width of the pair manager tray 114.

Viewing pair manager tray 114 from above with the front or tray portion down, position 8 160 is the left most trough 148. Position 1 162 is the trough 148 furthest right. Outer walls 164 on each side support the pair manager cap 116. Y-passage 152 splits into two separate channels 166 that open roughly in line with troughs 148, at position 6 168 and position 3 170. Thus, the conductor pairs 138 are isolated in the same position and orientation from one UCT connector 102 assembly to the next. The fixation of conductor pairs 138 in channels 136, Y-passage 152 and channels 166 reduces performance variation and creates predictable signal performance.

Pair manager tray 114 provides half of the squeezing effect onto the outer jacket 122 when assembled to connector housing 118. The squeezing action retains the cable 124 and assembled UCT connector 102 and provides strain relief. Assembly to the connector housing 118 is accomplished through the stepped rail surface 172 of pair manager tray 114 and four protruding catch features 174 located in the rear region 140 of pair manager tray 114. Catch features 174 are positioned in the locality of the cradle 146 to aid in the squeezing effect on the cable 124.

Figures 6, 7, 8:
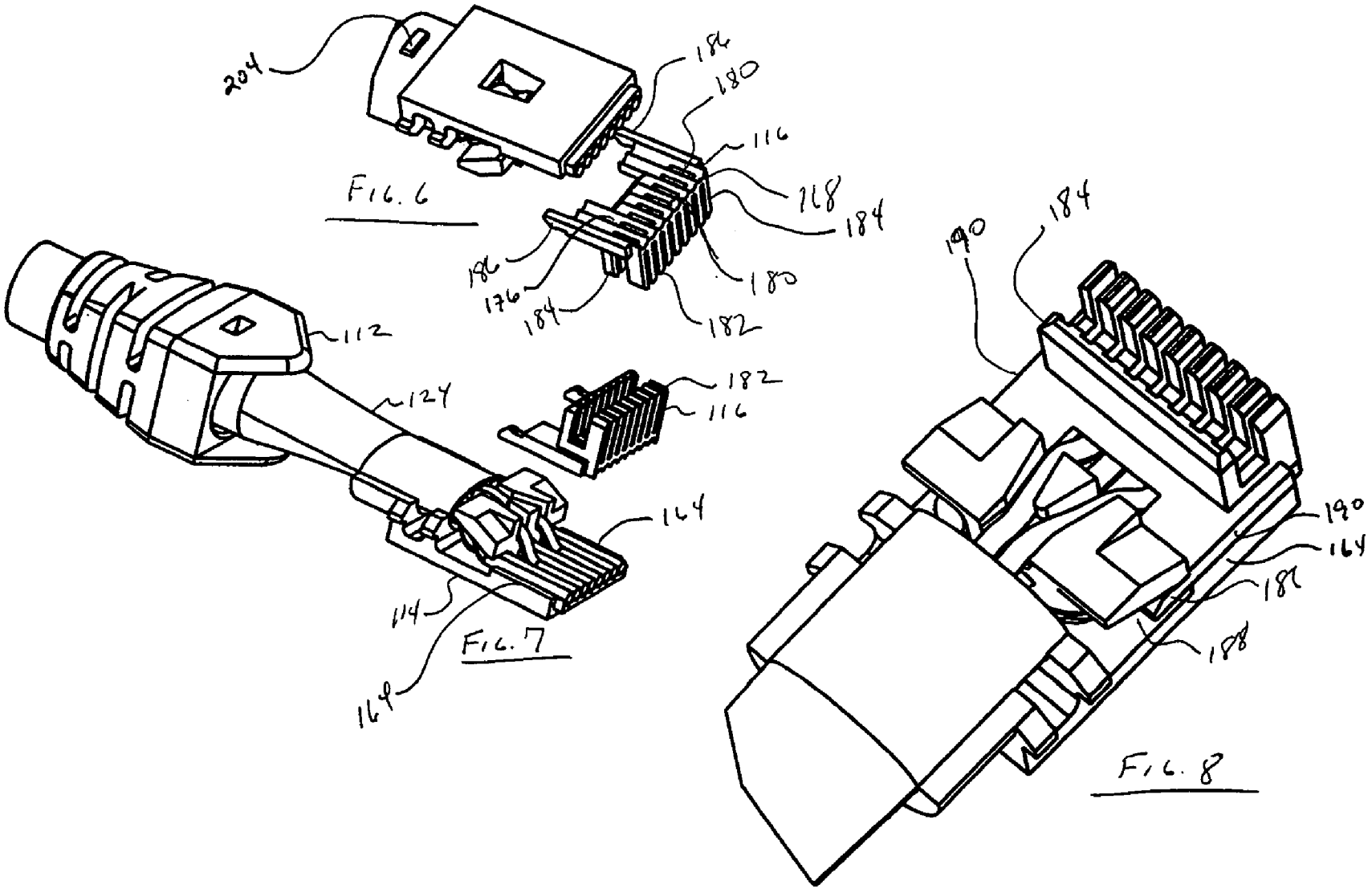
FIG. 6 is a bottom perspective view of a pair manager tray and pair manager cap in accordance with the present invention.
FIG. 7 is a top perspective view of the pair manager tray and pair manager cap.
FIG. 8 is a perspective view of a pair manager tray and pair manager cap as assembled.
Figure 10:
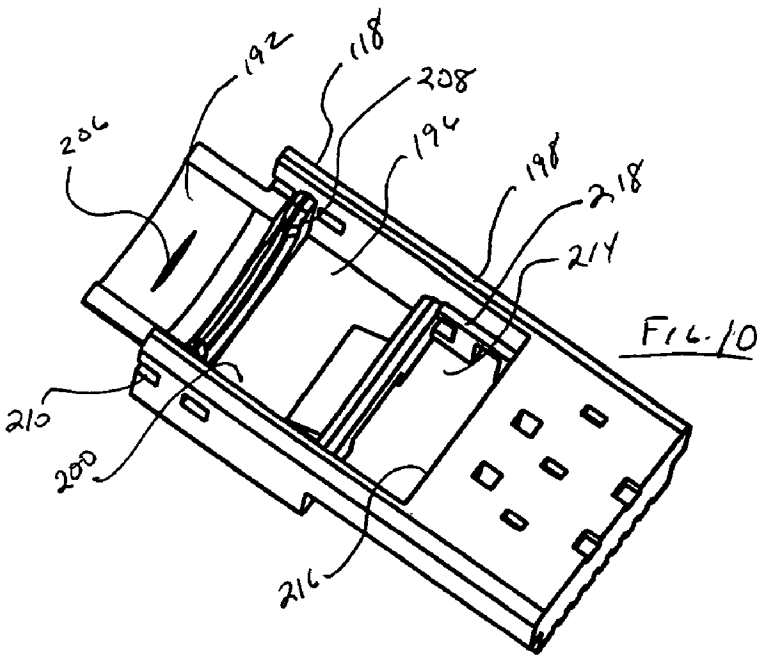
FIG. 10 is a bottom perspective view of the connector housing.
Figure 9:
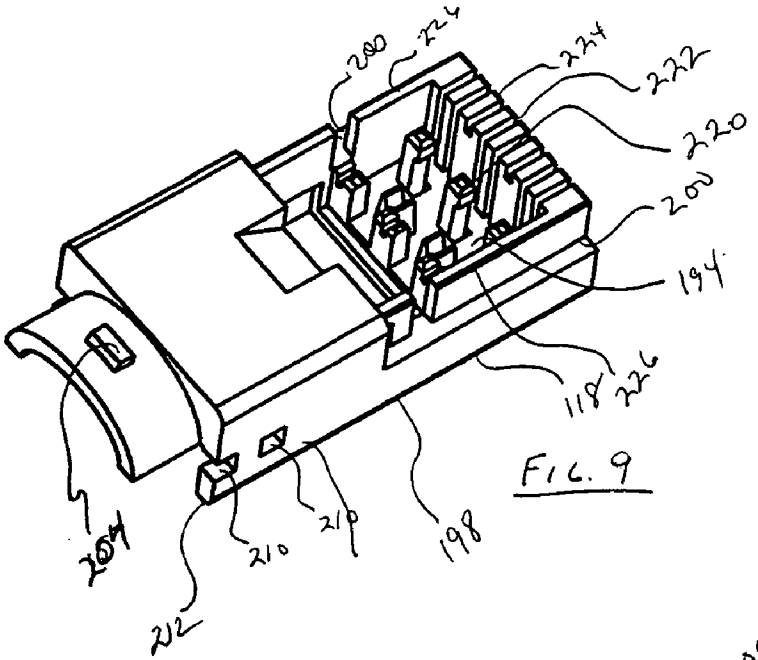
FIG. 9 is a top perspective view of a connector housing in accordance with the present invention.

Referring to FIGS. 6–8, pair Manager Cap 116, when set in place, captures individual conductors 126 in the semi-cylindrical troughs 148 of the pair manager tray 114. Pair Manager cap 116 includes semi-cylindrical troughs 176 that mirror those in the pair manager tray 114. These features, when assembled to pair manager tray 114, create eight adjacent partially separated cylindrical channels that capture and hold conductors 126 in a repeatable position so that each conductor 126 can be physically and conductively pierced to carry the electrical signals beyond the conductors 126. Pair manager cap 116 also presents rectangular windows 180 into troughs 176. Rectangular windows 180 connect to slots 182 in the protruding wall structure 184 on the top of pair manager cap 116. Pair manager cap 116 is held to pair manager tray 114 temporarily by two latching legs 186. Latching legs 186 make an interference fit into outer channels 188 of pair manager tray 114 and cannot slide out. The pair manager cap 116 is fully secured to the assembly when the pair manager tray 114 and pair manager cap 116 sub-assembly is installed into the connector housing 118. Outer rails 190 of the pair manager cap 116 are held between the outer walls 164 of the pair manager tray 114 and interior walls of the Connector Housing 118. Pair manager cap 116 becomes sandwiched into the assembly and therefore held secure.

Referring to FIGS. 9–12, connector housing 118 includes cable entrance cradle 192 similar to cradle 146 of pair manager tray 114, a forward cavity 194 and aft cavity 196, in a central region 198. Cable 124 enters the rear of connector housing 118. The front of connector housing 118 defines a key shaped cross section created by two stepped ledges 200. Aft cavity 196 presents cavity opening 200. Aft cavity 196 opens to the bottom and houses the mid-region 142 of the pair manager tray 114 that isolates the conductor pairs 138.

Entrance cradle 192 of connector housing 118 and the Pair Manager tray 114 are mirror images when assembled and oppose one another to create an oval shaped cross section when assembled. Latches 204 engage window slots 132 to secure Strain relief boot 112 to connector housing 118 and pair manager tray 114. Blade 206 within entrance cradle 192 bites into the outer jacket 122 and provides axial retention between UCT connector 102 and cable 124. When the connector housing 118 and pair manager tray 114 are assembled together, with the outer jacket 122 in between, the relatively round section of the cable 124 becomes squeezed into a oval shape that is sized to somewhat constrict the cable 124 volume. Connector housing 118 also includes interlocking wall 208 that seats within channel 158 of pair manager tray 114. Interlocking wall 208 creates adjacent, opposing pressures upon the outer jacket 122 when assembled. The combination of the interlocking wall 208 and semi-oval cradle 146 and entrance cradle 192, create reliable retention of the UCT connector 102 to cable 124 as well as providing a strain relief between cable 124 and isolated conductors 126.

Connector housing 118 has openings 210 in the rear sidewalls 212 that correspond to the catch features 174 in pair manager tray 114. Forward cavity 194 of connector housing 118 opens to the top of the connector housing 118. Open central region 214 corresponds to the front region 144 of pair manager tray 114 and pair manager cap 116 when assembled to connector housing 118. Step 216 engages to stepped rail surfaces 172 of pair manager tray 114. Catch features 174 of pair manager tray 114 engage openings 210 in rear sidewalls 212 of connector housing 118. When the assembly is complete, pair manager cap 116 is captured by pair manager tray 114 and step features 218 of connector housing 118.

Forward cavity 194 in connector housing 118 includes structures to house termination contacts 120 and create a mating interface with a jack port. Towers 220 protrude from the floor to secure and retain Termination Contacts 120. Forward cavity 194 also presents a series of slots 222 in the front wall 224 of connector housing 118. Slots 222 correspond in alignment and function with slots 182 in pair manager cap 116. Slots 222 secure and hold Termination Contacts 120 in alignment and spacing to allow connection with desirably an RJ45 jack port. In addition to creating an interface with jack ports, forward cavity 194 electrically compensates and controls cross talk between conductor pairs 138 or signal paths.

Figure 18:
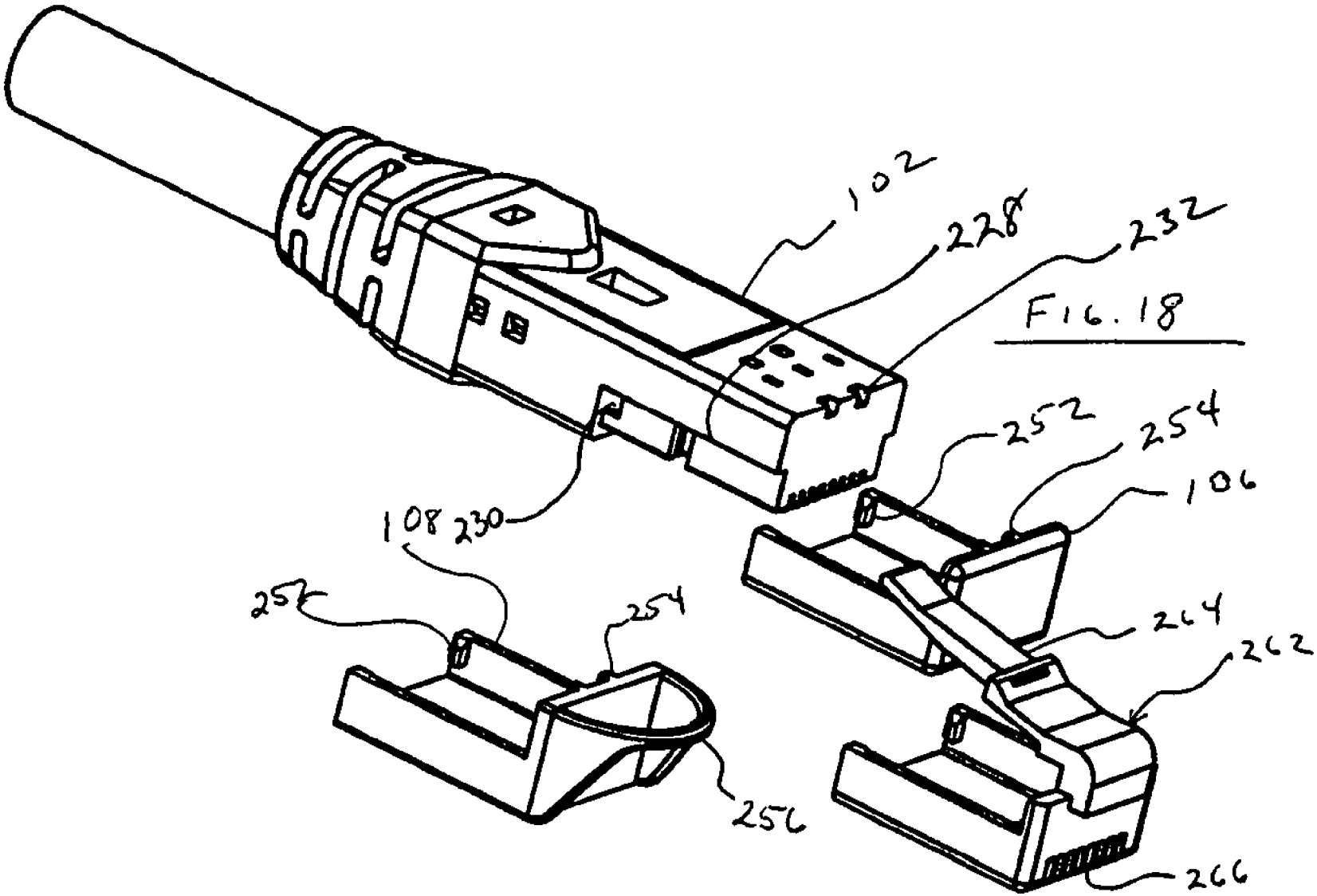
FIG. 18 is a perspective view of the UCT connector with a dust cover a pull ring cover and an RJ adapter cover.
Figure 19:
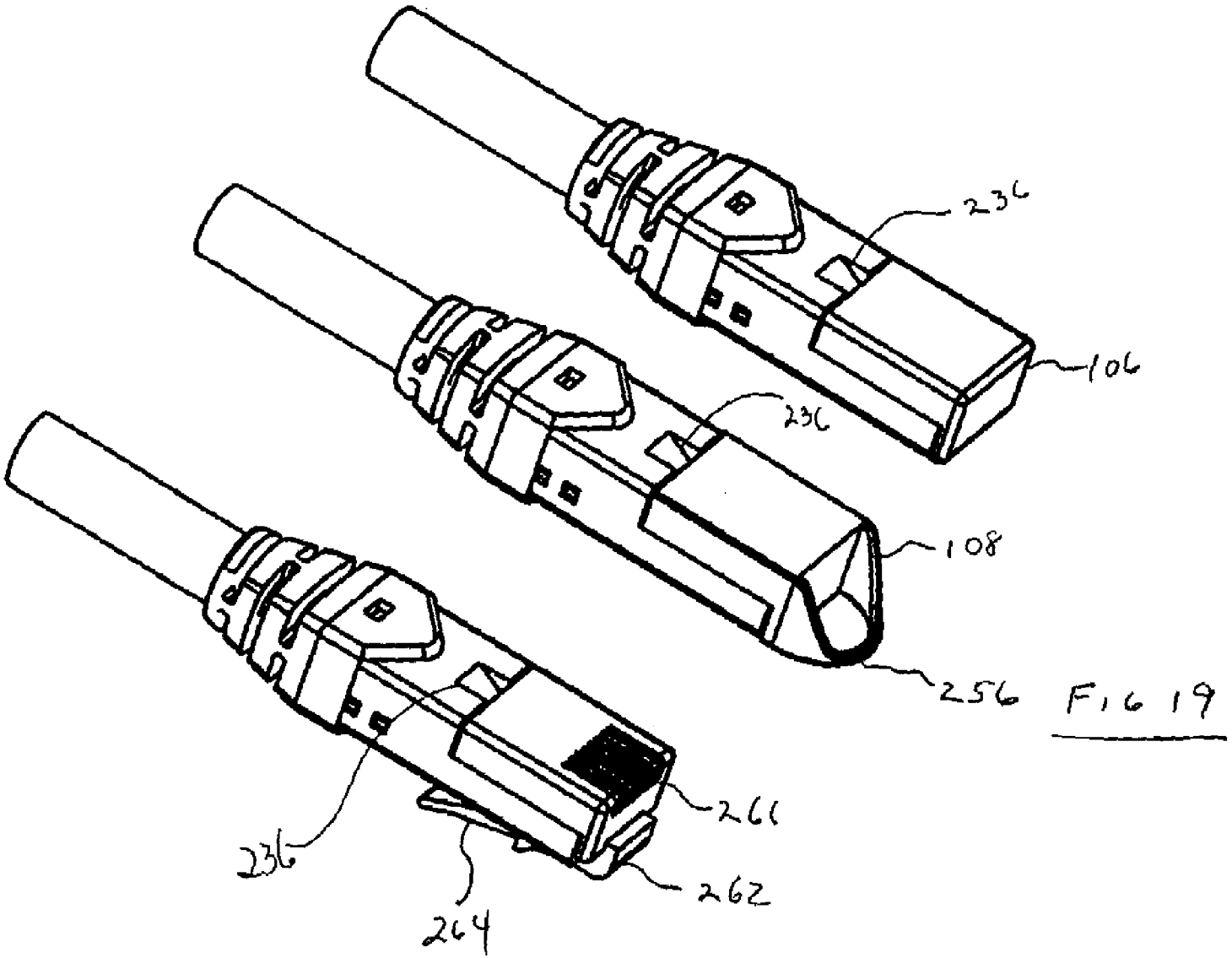
FIG. 19 is a perspective view of three UCT connectors assembled with the dust cover the pull ring cover and the RJ adapter cover respectively.

Referring to FIGS. 18–19, dust cover 106 and pull ring cover 108 can be assembled to UCT Connector 102. Connector housing 118 includes ledge 228 on both sides. Dust cover 106 or pull ring cover 198 rest on the ledges 228.

Connector housing 118 presents window openings 230 and notch features 232. Window openings 230 are on both sidewalls of the forward cavity 194.

Connector housing 118 also presents angled channel 236. A blade type tool may be inserted into angled channel 236 to remove dust cover 106 or pull ring cover 108.

Termination contacts 120, as depicted in FIGS. 13–17, may be fabricated from copper alloy and gold plated. Termination contacts 120 preferably include three unique contact designs. UCT connector 102 includes 8 conductors 126 and 8 termination contacts 120.

Each termination contact 120 includes spear 238. Spear 238 pierces through the conductor 126 insulation jacket and seats into the soft copper of the conductors 126.

UCT connector 102 is a multipurpose connector. Termination contacts 120 are designed with two contact interface points to accommodate either RJ45 or UCT connector. The RJ45 contact 240 makes contact with an RJ45 port by wiping over spring form contacts in the jack. The presence of the RJ45 contact 240 in the jack port deflects the spring form contacts to create a contact force and allows for electrical signal to pass from the plug to the jack and vice versa.

Another type of contact interface includes an array of blade portions 242 in termination contacts 120. These blade portions 242 slide between a two-pronged contact, known in the industry as an insulation displacement contact, or IDC, that resides in a jack which will be discussed in greater detail below. The material thickness of the termination contacts 120, or thickness of the blade portions 242, is greater than width of a pre-sized gap in the two prong IDC contacts. When slid together or mated, the blade is pushed into the gap of the two-pronged IDC contact. Deflection of the prongs creates contact force in the mated region that physically and electrically mates the termination contact 120 to that of the jack contact. This allows the electrical signal to pass through the mated contact. When the blade portion 242 of the termination contacts 120 are removed from the IDC two prong contacts in the jack, the prongs return to their original or un-deflected state.

Termination contacts 120 also include mid-bridge structures 244. Mid-bridge structures 244 may take on any number of configurations and spatial relationships to one another. The purpose for the specific spatial orientation and configuration of the mid-bridge structure 244 from one contact to the others relates to electrical compensation and cross talk control. Mid-bridge structures 244 may stagger up and down from one contact to the next. Mid-bridge structures 244 of Termination Contacts 120 may also intertwine with one another.

Figure 14:
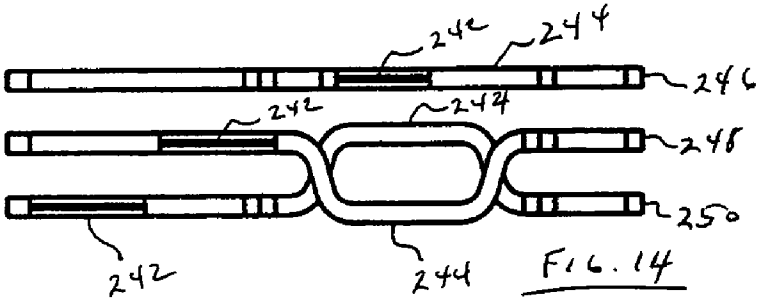
FIG. 14 is a top plan view of the three termination contacts.
Figure 15:
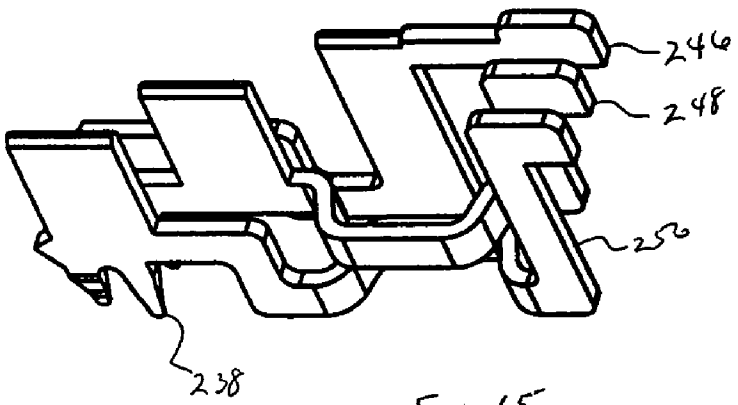
FIG. 15 is a perspective view of the three termination contacts as nested together.
Figure 13:
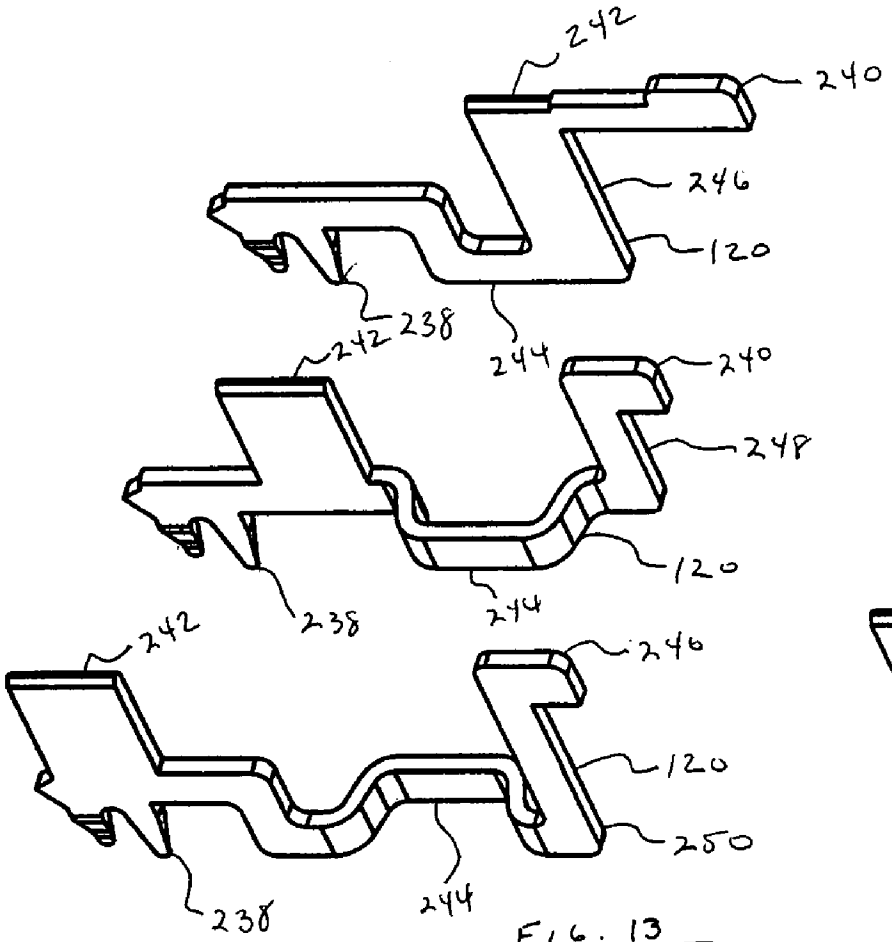
FIG. 13 is an exploded perspective view of three termination contacts in accordance with the present invention.

Referring now to FIGS. 13–15, termination contacts 120 may include straight contact 246, right hand contact 248, and left hand contact 250. Straight contact 246, right hand contact 248, and left hand contact 250 each include forked spear 238, RJ45 contact portion 240, blade portions 242, and mid-bridge structure 244 as discussed above.

Straight contact 246 is substantially planar with mid-bridge structure 244 being substantially in the same plane as forked spear 238, RJ45 contact portion 240, and blade portion 242. Right hand contact 248 differs in that mid-bridge structure is displaced horizontally from the remainder of right hand contact 248. In addition, blade portion 242 is displaced away from RJ45 contact as compared to straight contact 246. Thus, in straight contact 246 blade portion 242 is adjacent to RJ45 contact portion 240 whereas in right hand contact 248, blade portion 242 is separated from RJ45 contact 240 by mid-bridge structure 242.

Left hand contact 250 has a leftward displacement of mid-bridge structure 244. In addition, blade portion 242 is displaced to be substantially above forked spear 238.

As can be seen in FIGS. 13–15, straight contact 246, right hand contact 248 and left hand contact 250 can be nested together very compactly so that mid-bridge structures 244 are arranged in relation to each other for electrical compensation and to control cross talk production.

Referring to FIG. 16, it can be seen that exemplary UCT connector 102 includes two of straight contact 246, three of right hand contact 248 and three of left hand contact 250, nested together and inserted into connector housing 118, so that each termination contact 120 is mechanically and electrically engaged with a conductor 126 and so that termination connectors 120 are supported by towers 220 and slots 222. It is notable that blade portions 242 of termination context 120 are neatly and compactly arrayed in a specific orientation with relation to one another.

Figure 24:
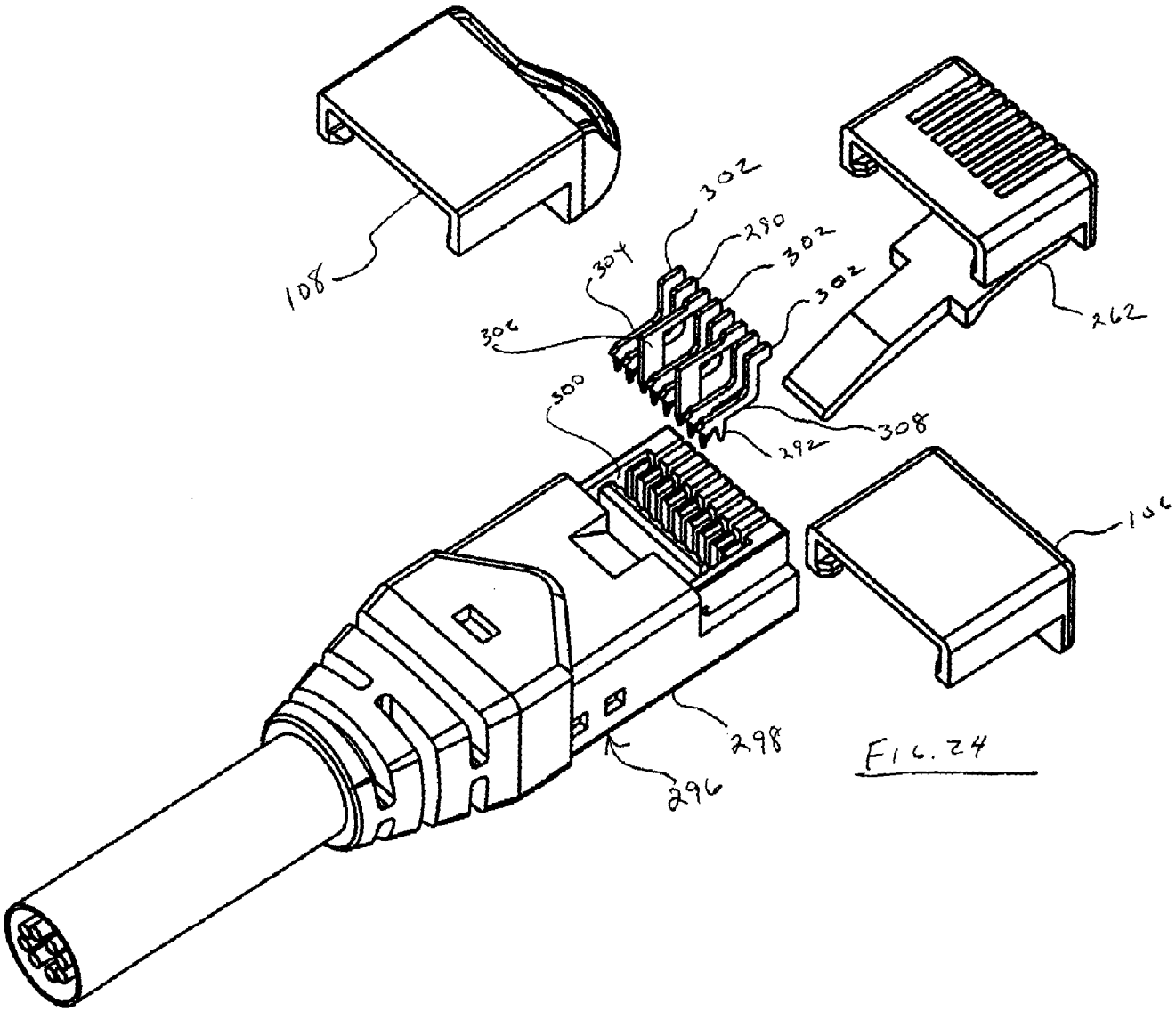
FIG. 24 is a partially exploded perspective view of an RJ short connector, a dust cover, a pull ring cover, and an RJ adapter cover in accordance with the present invention.
Figure 26:
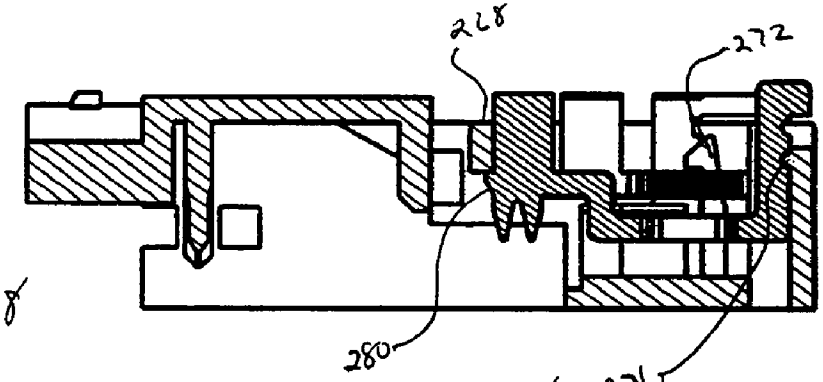
FIG. 26 is a sectional view of the connector housing with preloaded contacts.
Figure 27:
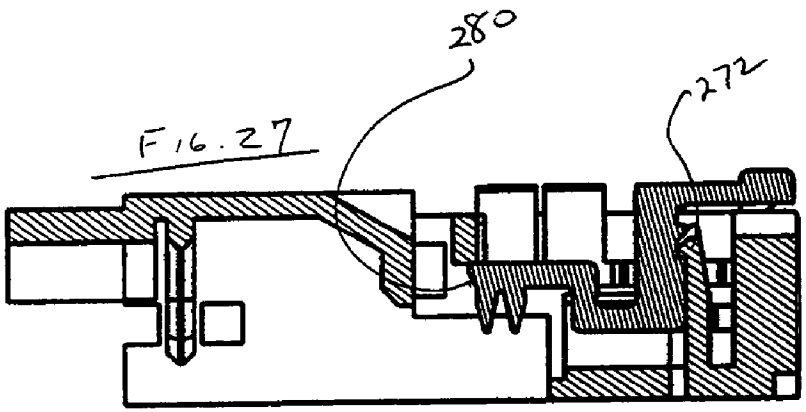
FIG. 27 is another sectional view of the connector housing with preloaded contacts.
Figure 25:
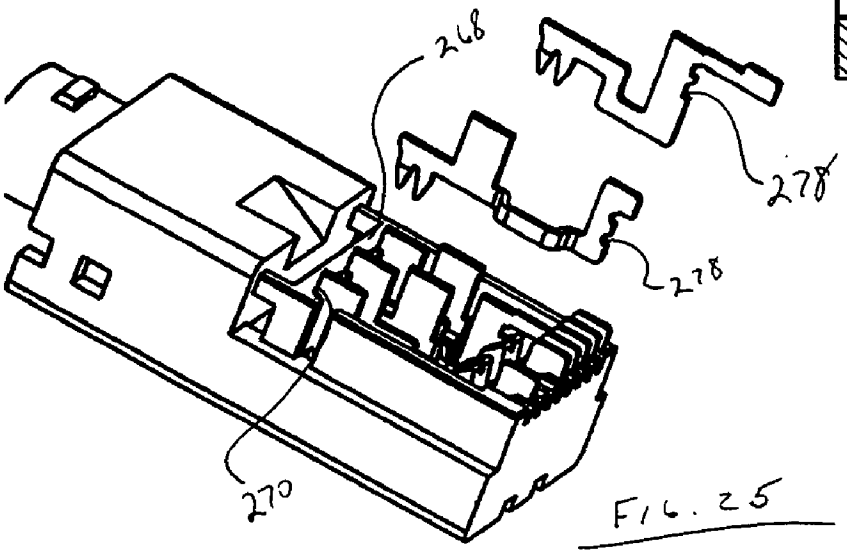
FIG. 25 is a perspective view of a connector housing with preloaded termination contacts in accordance with the present invention.
Figure 28:
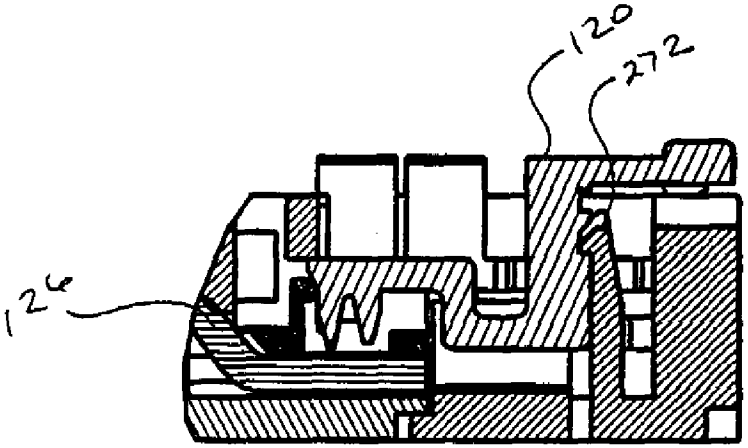
FIG. 28 is a detailed sectional view of the connector housing with preloaded contacts in an unterminated position.
Figure 29:
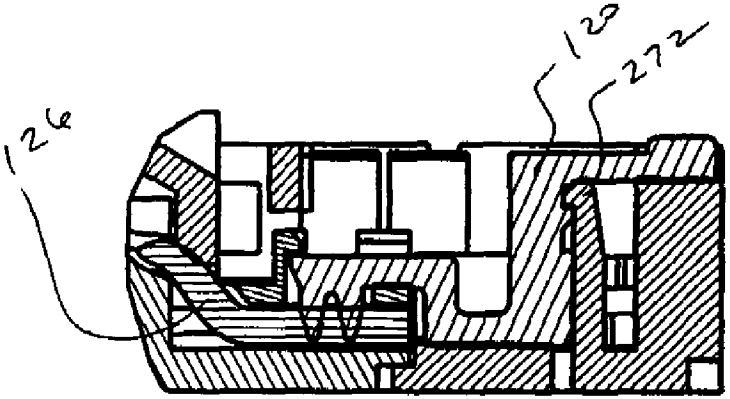
FIG. 29 is a sectional view of the connector housing with preloaded contacts in a terminated position.

Referring to FIGS. 18, 19 and 24 dust cover 106 can be utilized to protect UCT connector 102 during shipping, storage and handling. Dust cover 106 includes side latching bumps 252 and end latching bumps 254 which allow engagement to UCT connector. UCT connector 102 presents angled channel 236 which can be accessed with a blade type tool to release dust cover 106 from UCT connector 102.

Pull ring cover 108 is substantially similar in construction to dust cover 106 but also includes pull ring 256. Pull ring 256 may be engaged by a fish tape or other pulling device in order to pull UCT connector 102 and attached cable 124 through conduits or other pathways to install a network connection system 100.

Figures 20, 21:
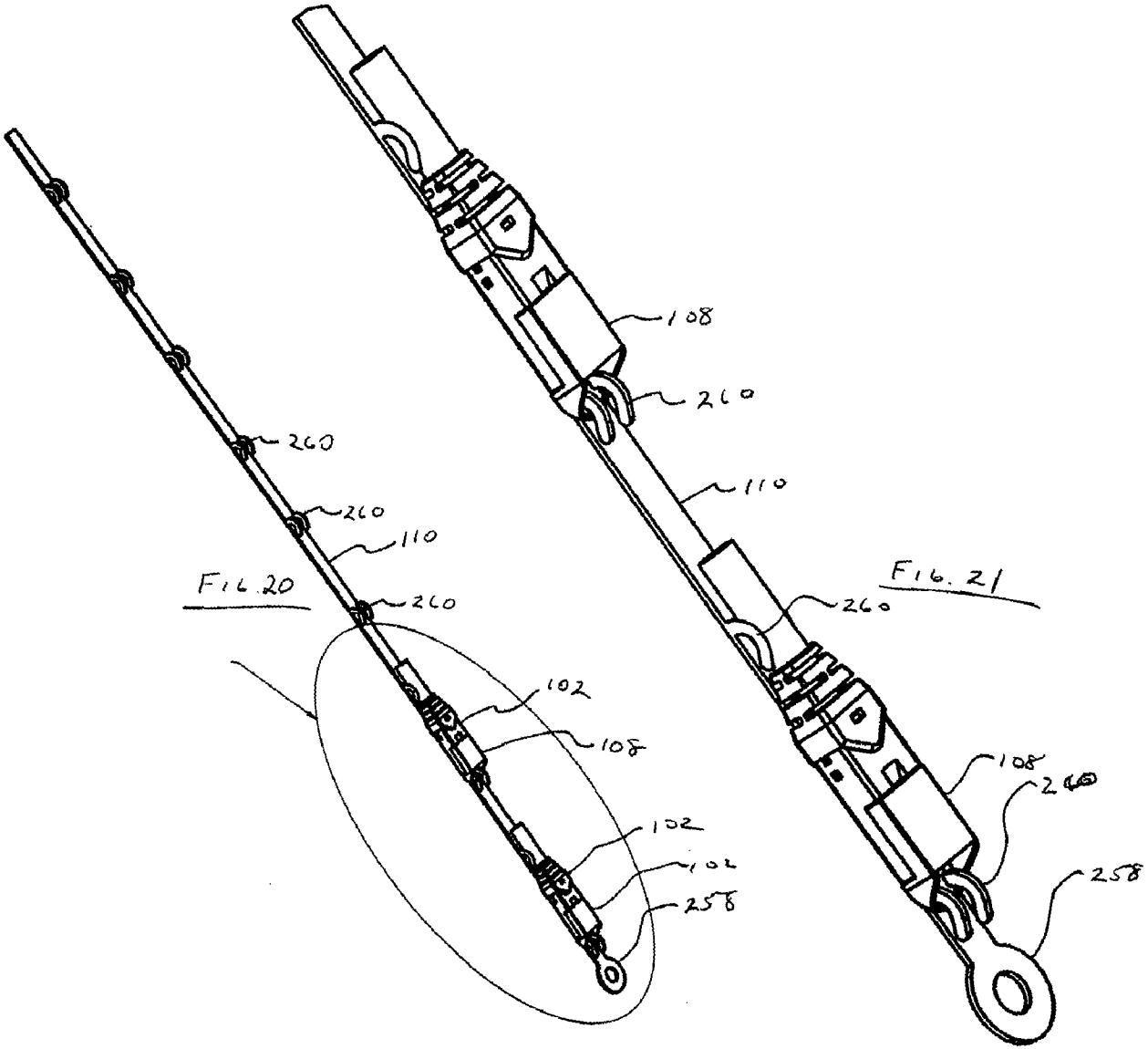
FIG. 20 is a feeder strip in accordance with the present invention attached to two UCT connectors with pull ring covers.
FIG. 21 is a detailed perspective view of the feeder strip taken from FIG. 20.

Referring to FIGS. 20 and 21, pull ring cover 108 can also be engaged to feeder strip 110. Feeder strip 110 presents pull lug 258 and pull ring hooks 260. Pull ring hooks 260 are adapted to engage pull rings 256 to allow pulling of multiple UCT connectors 102. Pull lug 258 may be engaged by a fish tape or other pulling device.

Referring to FIGS. 18, 19 and 24, RJ45 adapter cover 262 generally includes a structure similar to dustcover 106 with the addition of latching arm 264 and window slots 266. Latching arm 264 is adapted to engage with an industry standard RJ45 jack. Window slots 266 are aligned and positioned so that RJ45 contacts 240 of termination contacts 120 are exposed therethrough. This permits mating contact between the spring form contacts and those in an RJ45 modular jack when the UCT connector 102 with RJ45 adapter cover 262 is inserted into an RJ45 modular jack port. The features and dimensions of an RJ45 connector are well known and fully described by standardized industry specifications. Therefore they will not be further discussed here.

When RJ45 adapter cover 262 is utilized with UCT connector 102, the assembled UCT connector 102 with RJ45 adapter cover 262 can be attached to a computer or other peripheral item on a network without the need for an intervening jack. While this is not a part of the EIA/TIA standard it is a very useful application under some circumstances.

Referring to FIGS. 25 through 29, in another embodiment, UCT connector 102 may include a connector housing 118 preloaded with termination contacts 120. In this embodiment, connector housing 118 further includes bridge 268 with contact guide slots 270, latching beams 272 and retaining bumps 276. Termination contacts 120 further include notches 278 in two positions. As can be seen referring to the above figures termination contacts 120 can be located in a pre-terminated position or in a terminated position. Termination contacts 120 also include catch features 280 which can engage with bridge 268 to secure termination contacts 120 in the terminated or pre-terminated condition. Thus, termination contacts 120 may be moved from the pre-terminated position to the terminated position by applying pressure with a tool adapted to engage termination contacts 120.

Figure 22:
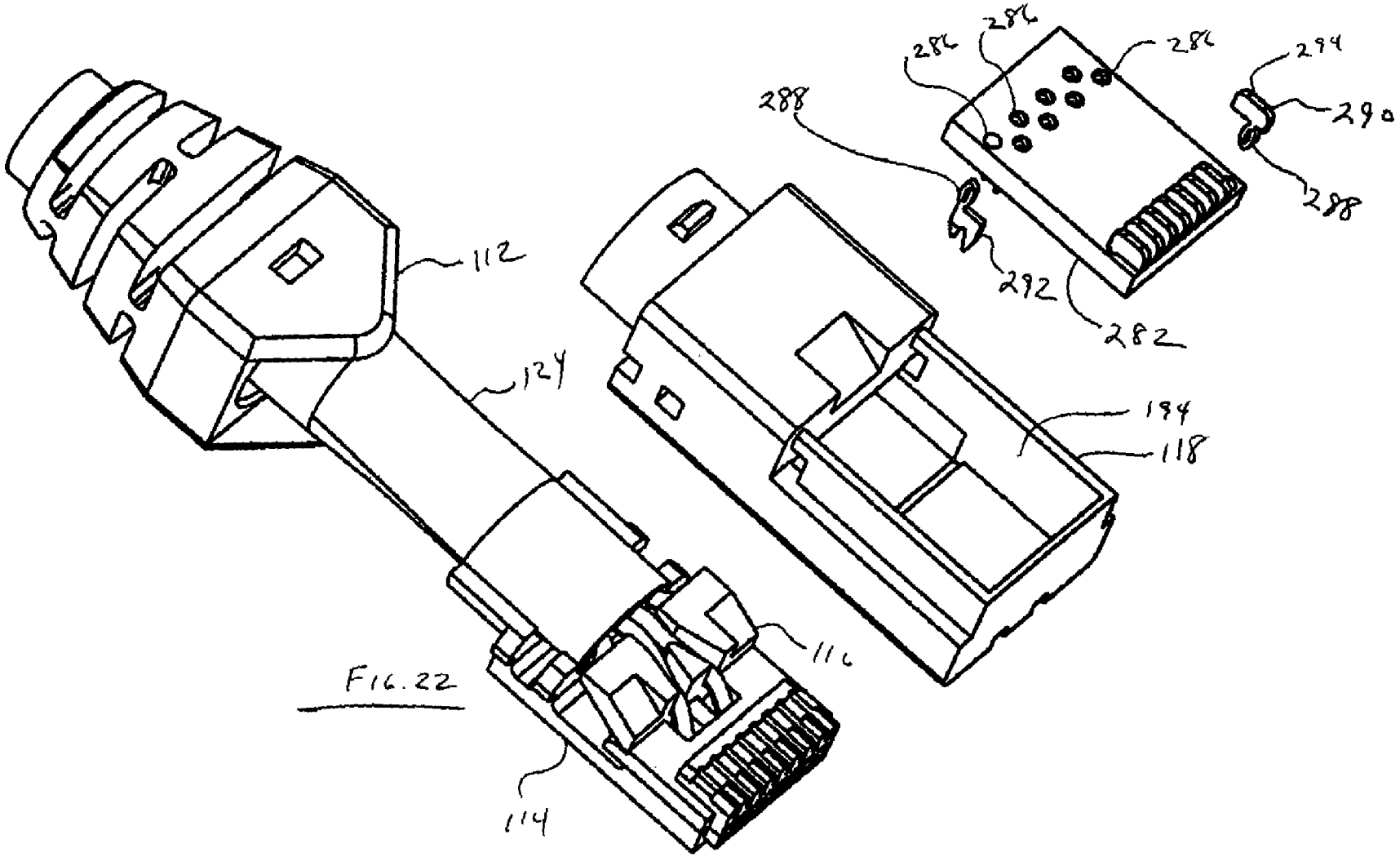
FIG. 22 is a partially exploded perspective view of a UCT connector including a printed circuit board in accordance with the present invention.
Figure 23:
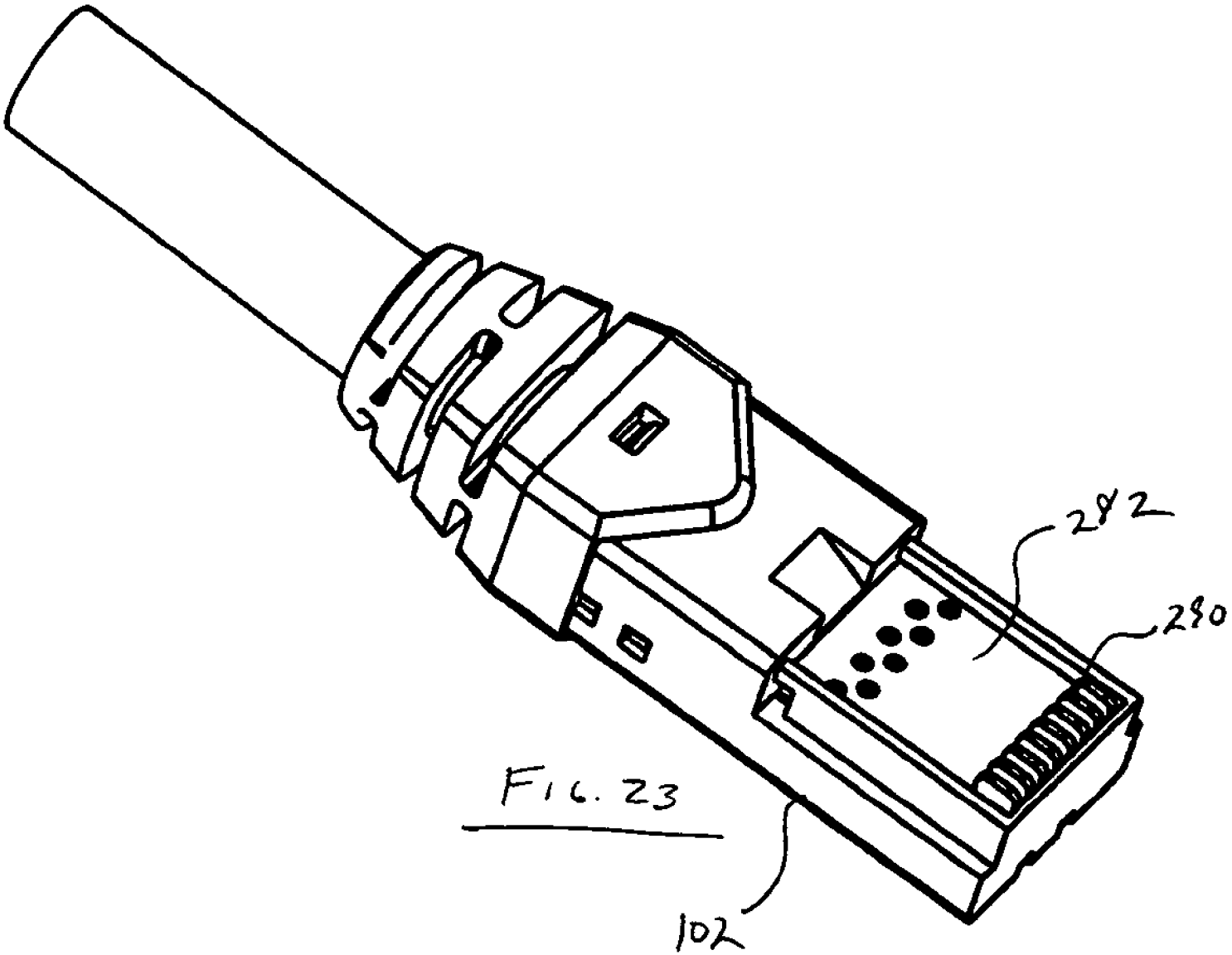
FIG. 23 is a perspective view of the UCT connector including a printed circuit board.

In another embodiment, depicted in FIGS. 22–23, UCT connector 102 may include printed circuit board 282 with edge contacts 284. The use of printed circuit board 282 with edge contacts 284, in this example, creates an RJ45 connector without IDC blade contact capability. This embodiment may however, be used with dust cover 106, pull ring cover 108 or RJ45 adapter cover 262 in a similar fashion to UCT connector 102.

In this embodiment, connector housing 118 lacks towers 220. Printed circuit board 282 is substantially rectangular and sized to fit inside forward cavity 194. Printed circuit board 282 may be single or multi-layered to achieve desired signal transmission performance requirements.

In this example, printed circuit board (PCB) 282 defines a series of eight plated holes 286 at two opposite ends thereof. Plated holes 286 are sized to receive compliant post 288 connected to either RJ45 contacts 290 or termination spears 292. RJ45 contacts 290 and termination spears 292 are positioned to correlate with positions 1–8 in UCT connector 102.

Termination spears 292 pierce conductors 126. Termination spears 292 attach to PCB 282 via compliant post 288. Compliant post 288 is slightly larger than plated hole 286 to create conductive connection with a conductive trace (not shown) of PCB 282. Plated holes 286 may be staggered in two lines. Termination spears 292 are desirably rotated 180 degrees every other termination spear 292 to align compliant posts 288 with plated holes 286.

RJ45 contacts 290 include blade feature 294 to make contact with spring contacts found in an RJ45 jack port. Compliant post 288 of RJ45 contact 290 engages PCB 282 in a manner similar to termination spears 292.

Network connection system 100 may also include RJ45 short connector 296 depicted in FIG. 24. RJ45 short connector 296 is intended for use at either end of a patch cable connecting a jack to a computer or other peripheral. It is not intended for use with a station cable. It is understood that the most ideal signal path in a connector can be found in the lay and twist of the cable conductors as they sit inside the cable jacket. A disruption to the twist of the cable pairs or a severe kinking of the cable can have adverse effects on the signal carrying performance of the cable. The network connection system 100 of the present system also includes RJ45 short connector 296. An advantage of short connector 296 is that it more closely approximates an ideal signal path. Shortening the connector reduces the effective electrical length and more closely approximates the ideal case.

RJ45 short connector 296 utilizes the same pair manager tray 114, Pair manager cap 116 and strain relief boot 112 as described above with regard to UCT connector 102. RJ45 short connector also utilizes dust cover 106, pull ring 108 and RJ45 adapter cover 262 in a similar fashion to UCT connector 102.

Short connector housing 298 is substantially similar in design to that described above for connector housing 118. However, the entire length of short connector housing 298 has been reduced as compared to connector housing 118. The length reduction occurs because short forward cavity 300 is shorter in length then forward cavity 194.

Referring to FIG. 24, short termination contacts 302 include termination spears 292 and RJ45 contacts 290, but lack blade portion 242. In addition, intermediate section 304 of short termination contacts 302 is shaped differently from termination contacts 120.

Short termination contacts 302 may include high path contact 306 and low path contact 308. In addition, short termination contacts 302 may include a diagonal path contact (not shown). The reason for this approach is well known to those skilled in the art and centers around managing the electrical coupling effect that occurs between closely located conductor pairs and efforts to isolate the split pair in positions 3 and 6 from the other adjacent pairs in a twisted pair assembly. RJ45 short connector 296 is utilized with RJ45 adapter. cover 262 for connection to an RJ45 jack to create a patch cable typically less than fifteen feet in length.

Connecting hardware 104 generally includes UCT to RJ45 adapter 310 and UCT to UCT adapter 312.

Figure 33:
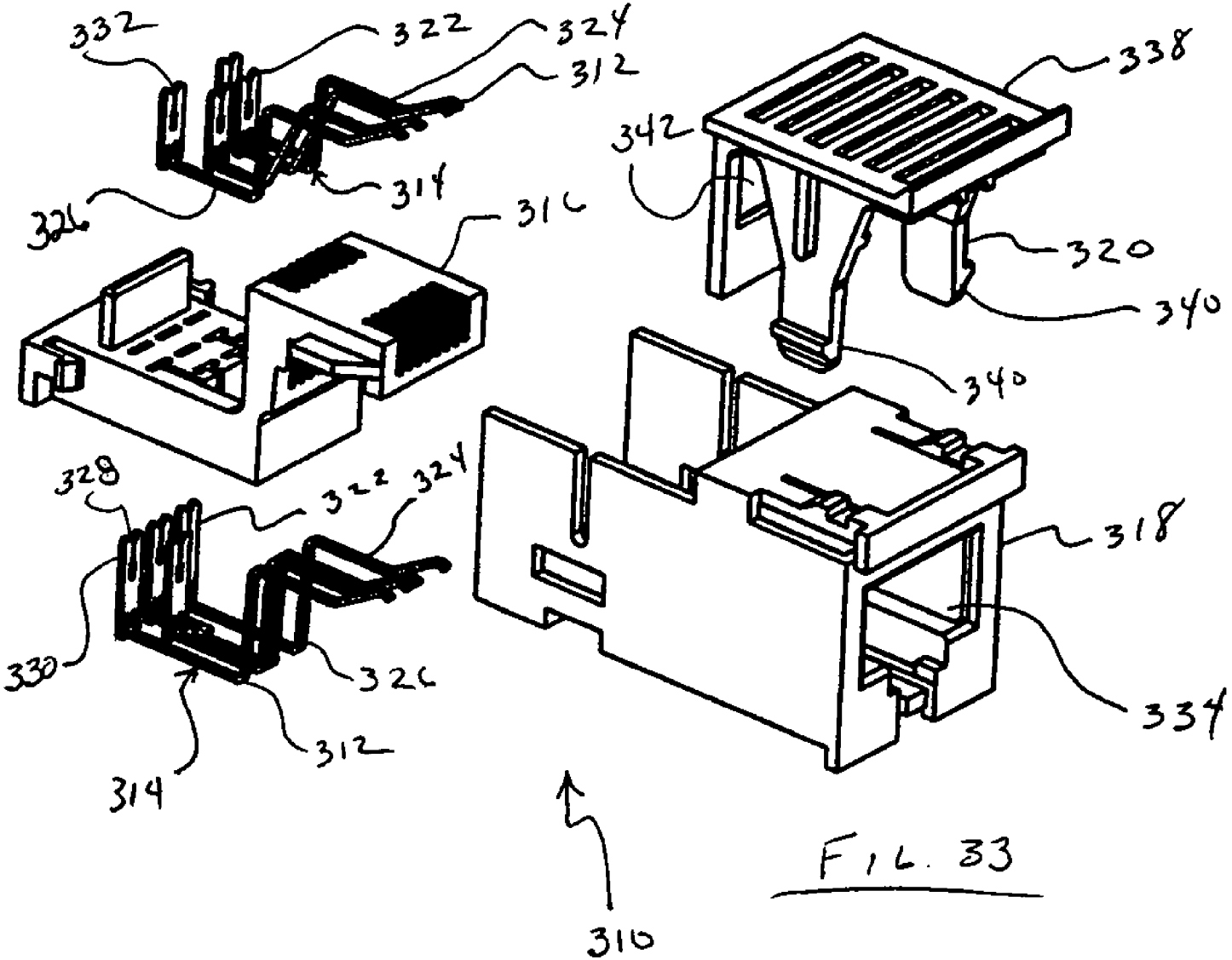
FIG. 33 is an exploded perspective view of the UCT to the RJ45 adapter in accordance with the present invention.

Referring to FIG. 33, an exemplary embodiment of UCT to RJ45 adapter 310 utilizes preformed contact springs 314. UCT to RJ45 adapter 310 also includes jack insert 316, jack housing 318 and termination cap 320.

Preformed contact springs 314 include split tine contact 322, cantilever beam contact 324, and connecting portion 326. Split tine contacts 322 are Insulation Displacement Contact (IDC) type split tine contacts having a predefined gap 328 created by two tines 330, and a tapered entry 332. Split tine contacts 322 receive blade 206 within gap 328 via tapered entry 332.

Connecting portion 326 electrically and mechanically connects cantilever beam contact 324 to split tine contact 322. Cantilever beam contact 324 extends away from connecting portion 326 and is resiliently deflectable to resist insertion of a mating connector and to create a contact force to assure electrical continuity with the mating connector.

Jack insert 316 supports and partially surrounds preformed contact springs 314 leaving cantilever beam contact 324 and split tine contact 322 exposed for connection to connectors inserted into UCT to RJ45 adapter 310.

Jack housing 318 encloses jack insert 316 and preformed contact springs 314 and defines RJ45 portion and UCT connector receiving portion 336 at opposed ends thereof. The features and dimensions of an RJ45 jack are well known and fully described by standardized industry specifications. Therefore they will not be further discussed here. Other RJ style connectors may be treated similarly.

Termination cap 320 is adapted to snap into jack housing 318 and to slidable, translate with jack housing 318. Termination cap 320 includes lid 338 and clips 340 and defines window 342. Clips 340 engage to jack housing 318. Window 342 is sized to receive UCT connector 102. Termination cap 320 is slidably shiftable between an open position and a closed position.

When in the closed position termination cap 320 secures UCT connector 102 electrically and mechanically within UCT to RJ45 adapter 310.

Figure 34:
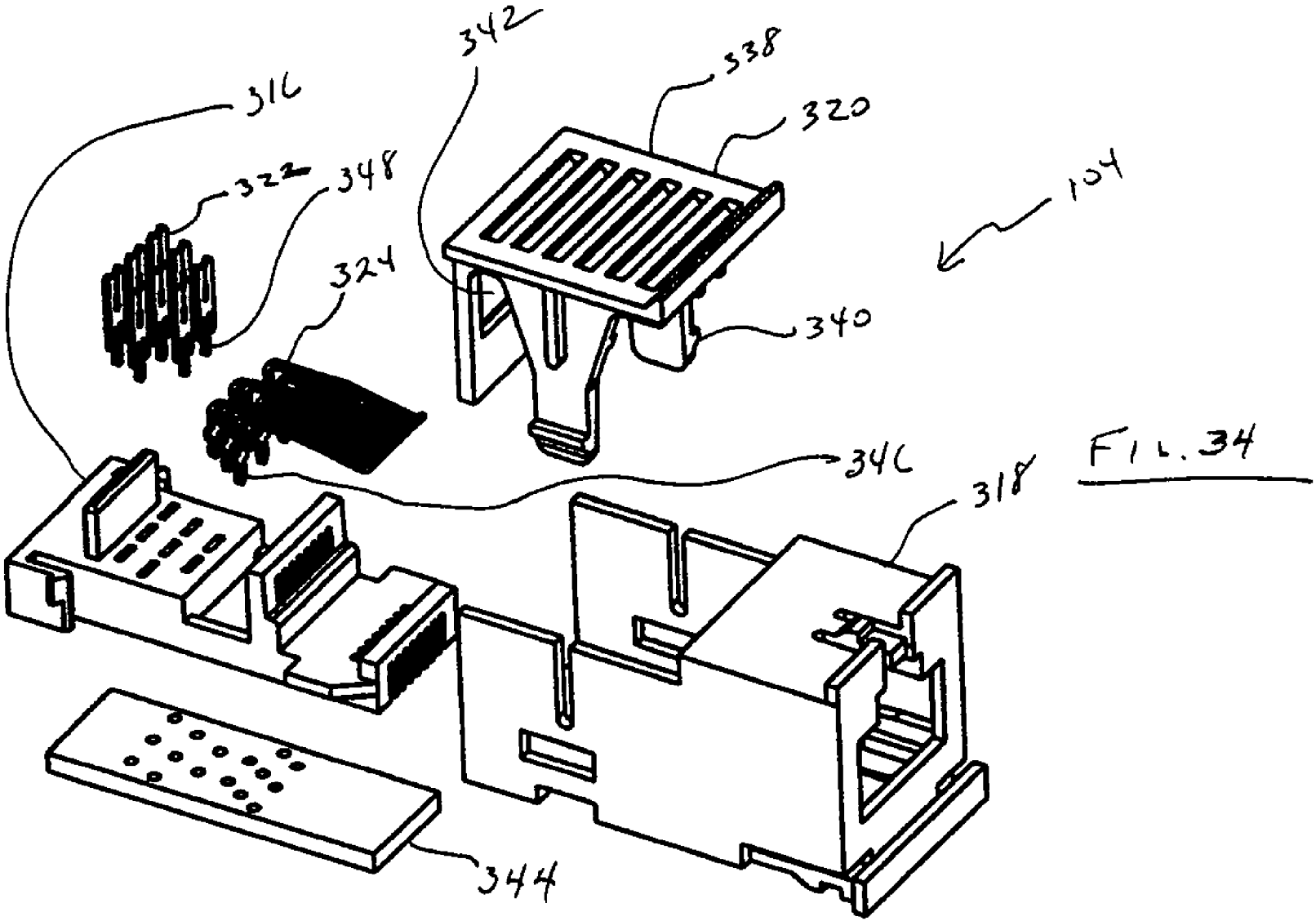
FIG. 34 is an exploded perspective view of an UCT to RJ45 adapter including a printed circuit board.
Figure 35:
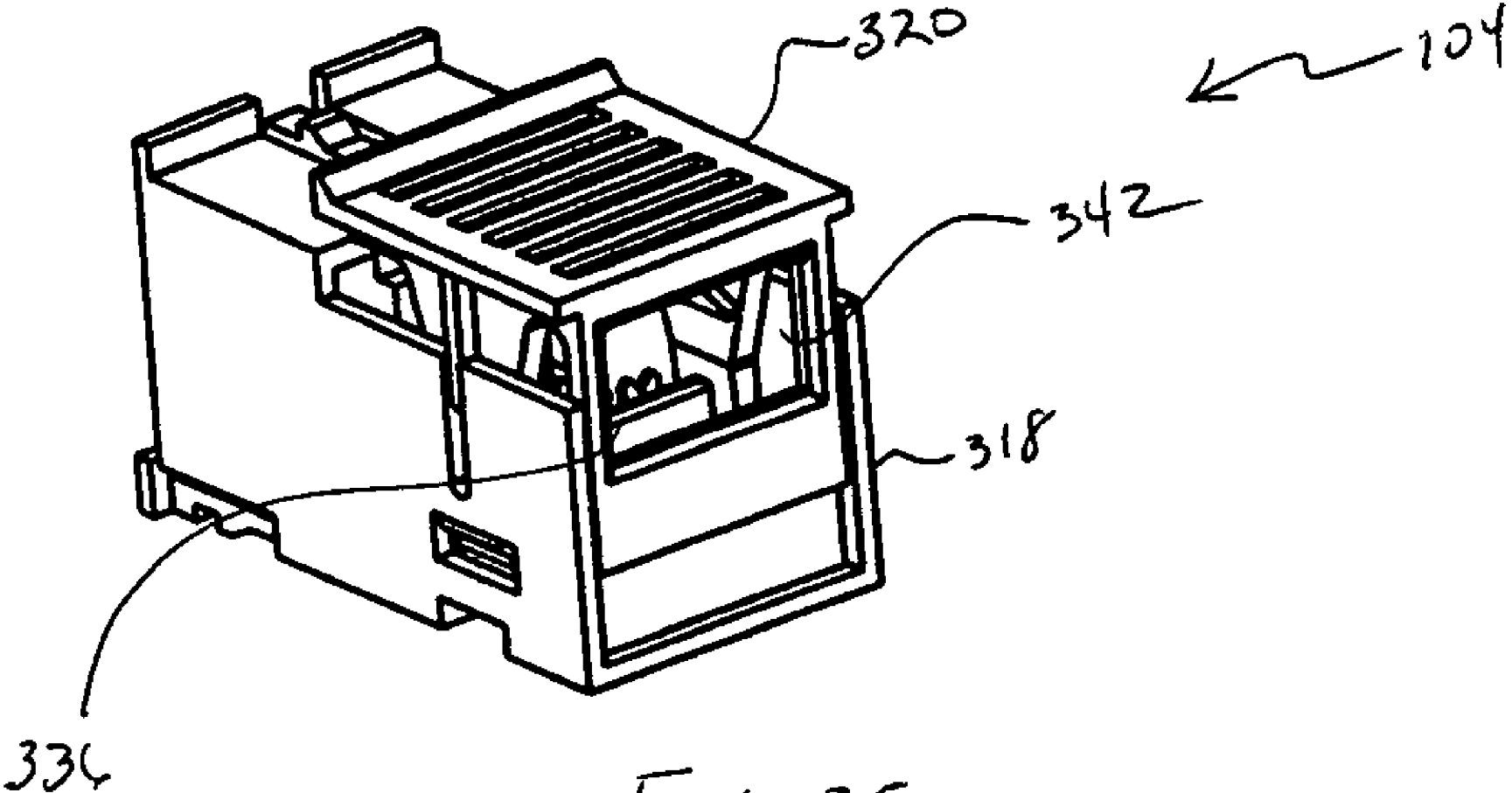
FIG. 35 is an assembled perspective view of UCT to RJ45 adapter including a printed circuit board.
Figures 36A, 36B, 36C, 36D, 36E:
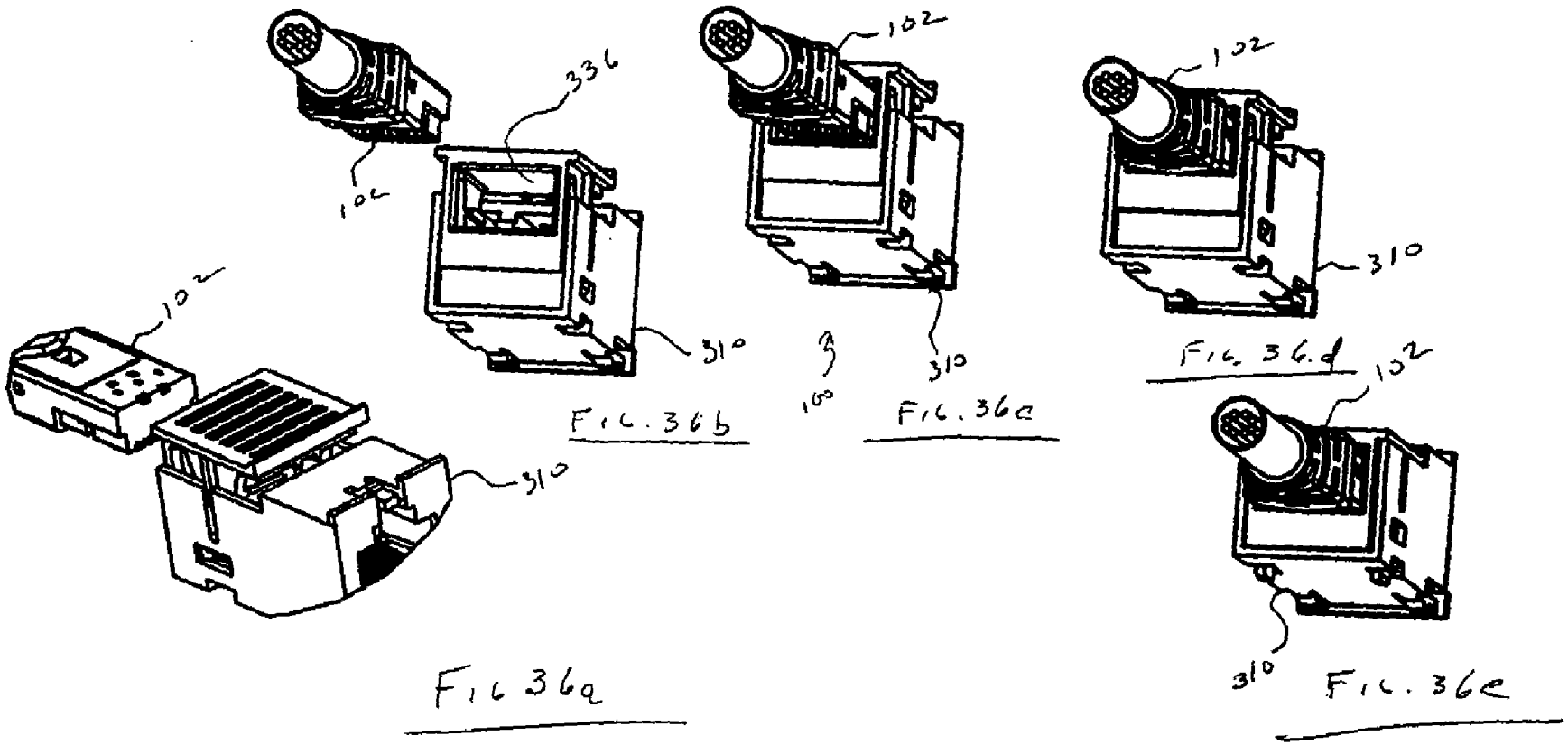
FIGS. 36*a*–36*e* are perspective views of a UCT connector being inserted and terminated into an UCT to RJ45 adapter in accordance with the present invention.

Referring to FIG. 34–35, in another embodiment, UCT to RJ45 adapter 310 includes printed circuit board bridge 344 (PCB bridge 344). In this embodiment PCB bridge 344 routes multiple signal paths from split tine contacts 322 to cantilever beam contacts 324. The use of a PCB bridge 344 provides the advantage of latitude in printed circuit board design for control and flexibility in managing the signal paths and their interaction with each other.

In this embodiment split tine contacts 322 are joined to PCB bridge 344 via compliant post 346 or solder post 348. Likewise cantilever beam contacts 324 can be joined to PCB bridge 344 by compliant post 346 or solder post 348. In this embodiment, jack insert 316 is altered to support PCB bridge 344, split tine contacts 322 and cantilever beam contacts 324. In addition, RJ45 portion 344 is rotated 180 degrees relative to UCT connector receiving portion 336.

Figures 37, 38:
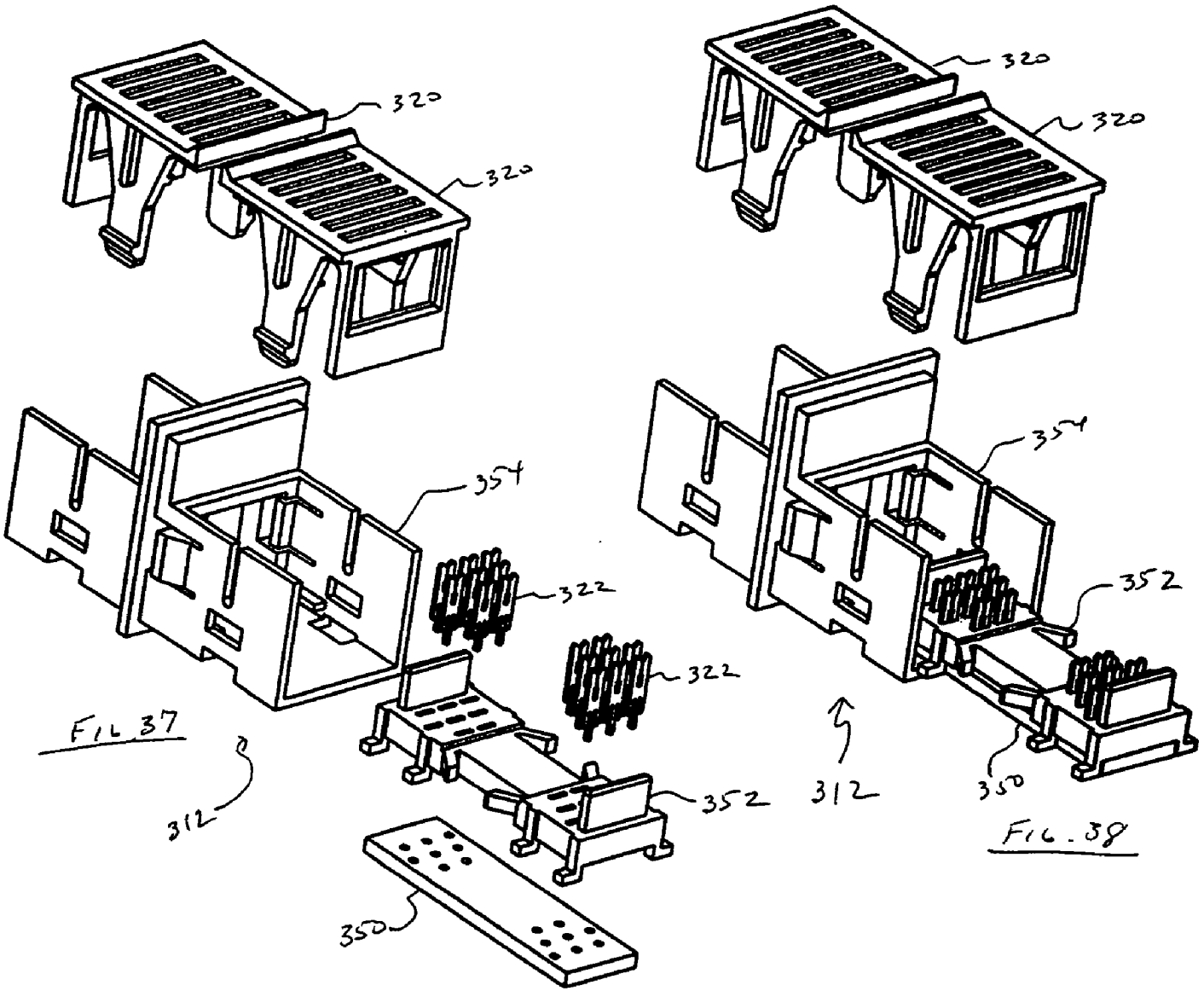
FIG. 37 is an exploded perspective view of the UCT to UCT adapter including a printed circuit board in accordance with the present invention.
FIG. 38 is a partially exploded perspective view of UCT to UCT adapter.

Referring to FIGS. 37–38, UCT to UCT adapter 312 may include PCB bridge 350. PCB bridge 350 receives split tine contacts 322. PCB bridge 350 is supported by jack insert 352 and surrounded by jack housing 354, which supports two termination caps 320.

Figures 39, 40, 41:
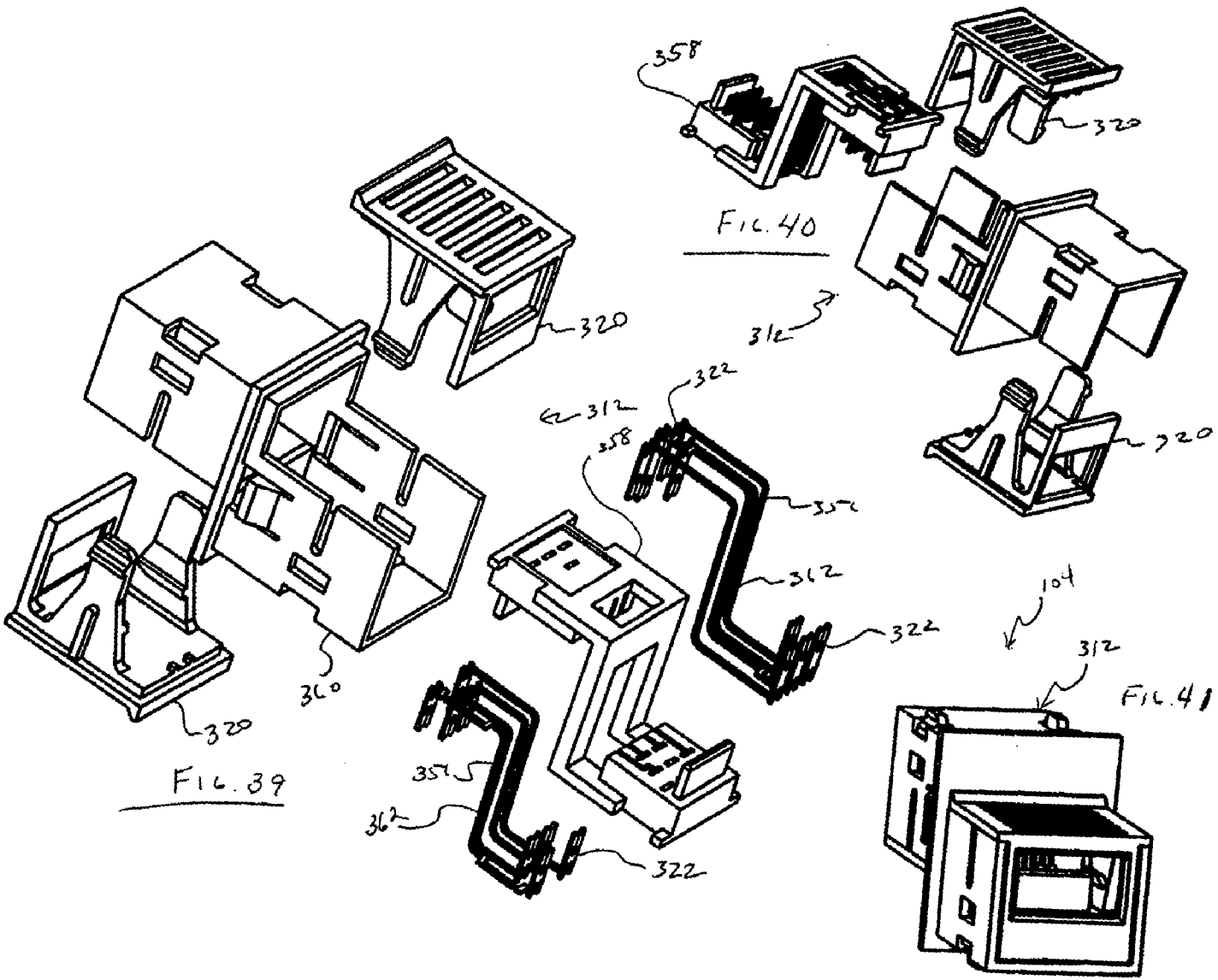
FIG. 39 is an exploded perspective view of another embodiment of the UCT to UCT adapter.
FIG. 40 is a partially exploded perspective view of the UCT to UCT adapter from FIG. 39.
FIG. 41 is an assembled perspective view of the UCT to UCT adapter from FIG. 39.
Figure 42:
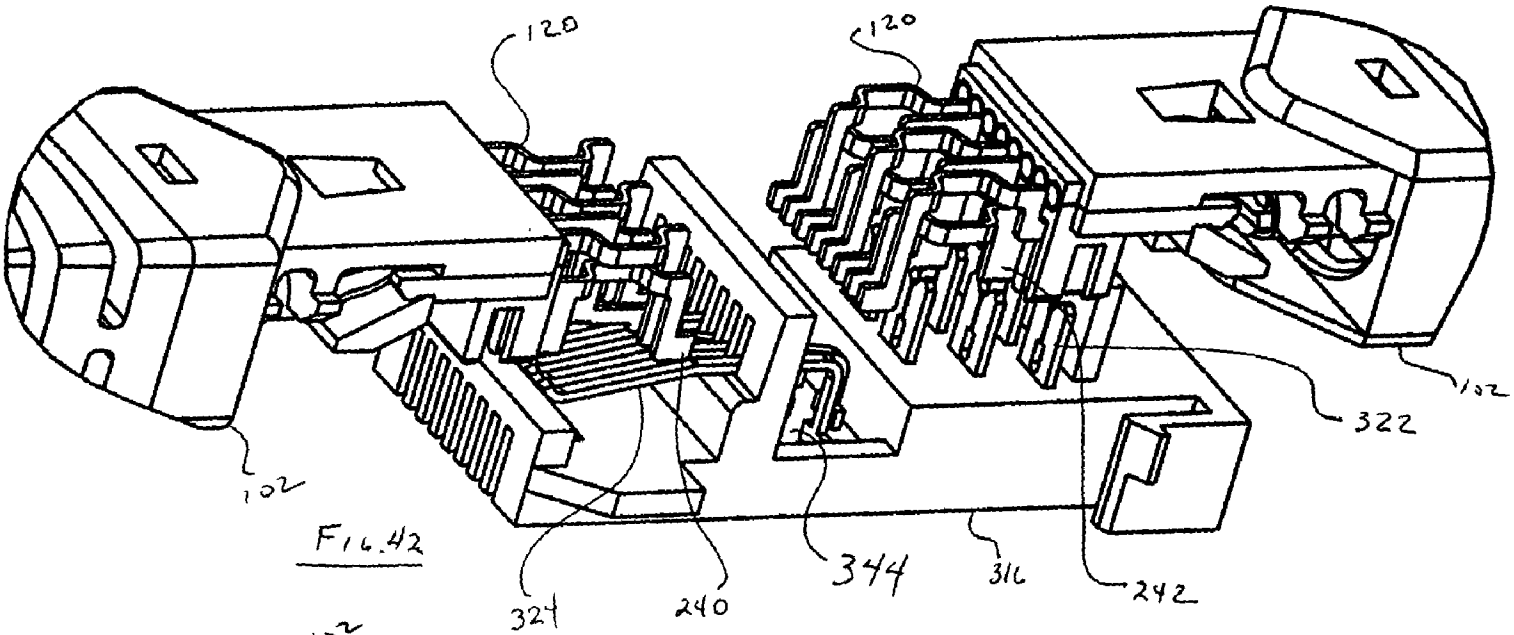
FIG. 42 is a perspective view of a UCT to RJ45 adapter and to UCT connectors with certain parts removed for clarity.
Figure 43:
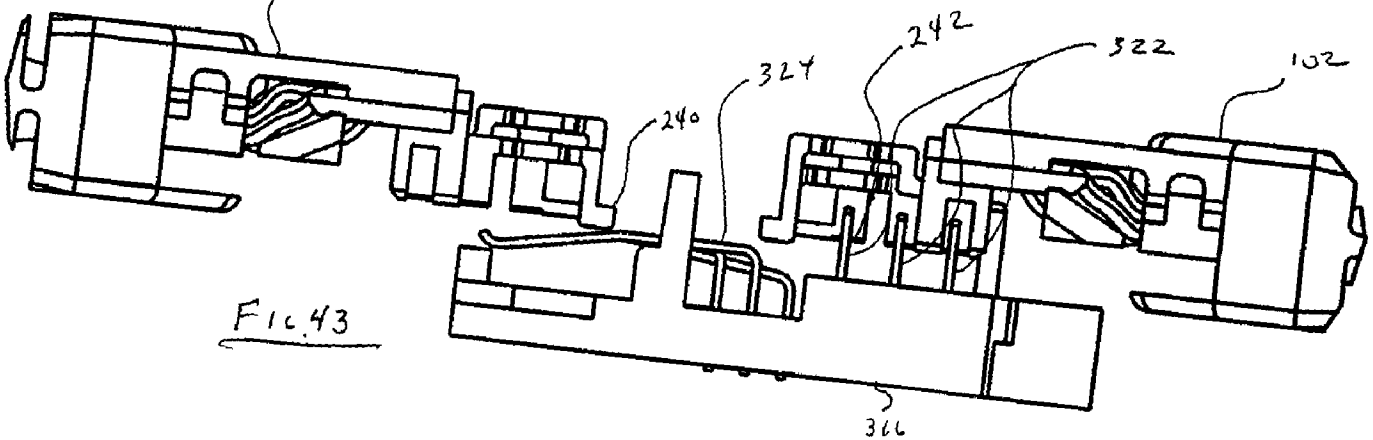
FIG. 43 is a cross-sectional view the UCT to RJ45 adapter and UCT connectors of FIG. 42.
Figure 44:
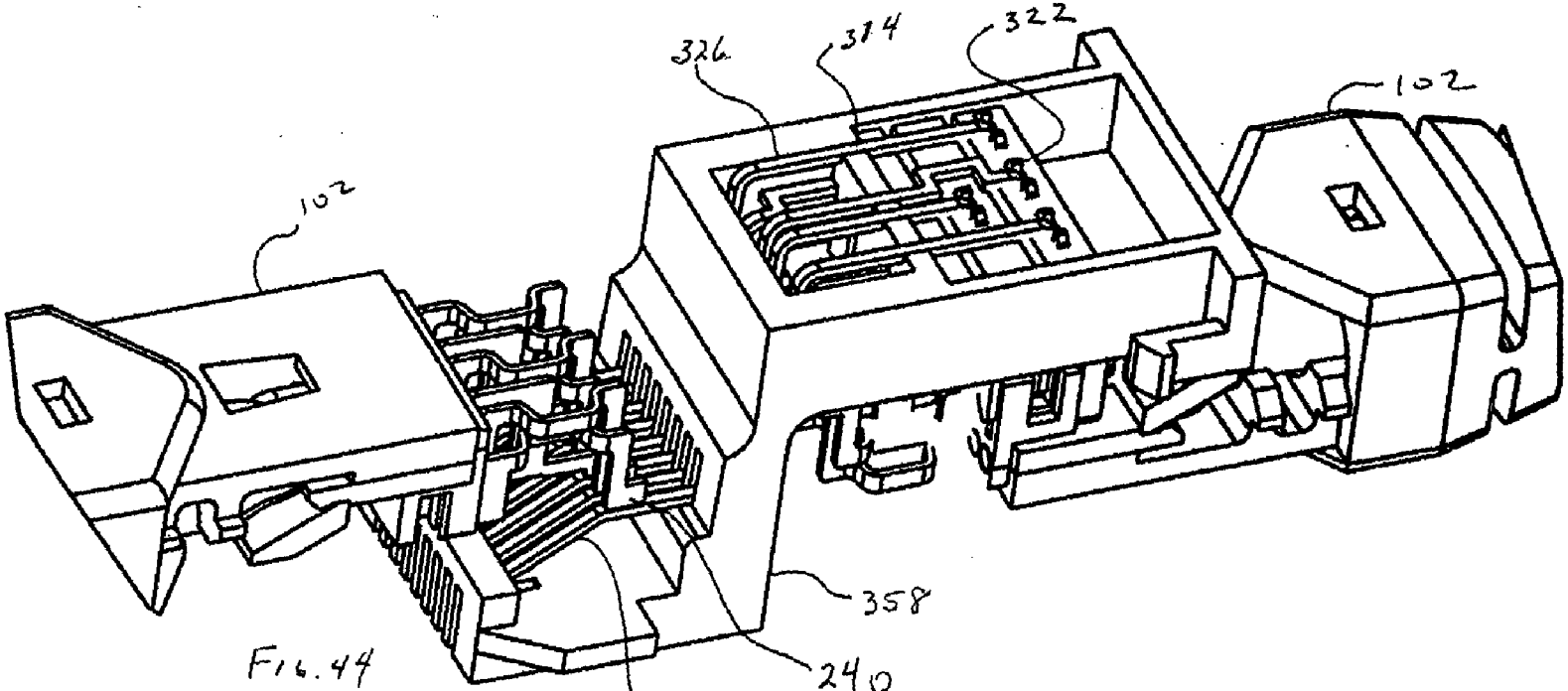
FIG. 44 is a perspective view of another embodiment of the UCT to RJ45 adapter and two UCT connectors with certain parts removed for clarity.
Figure 45:
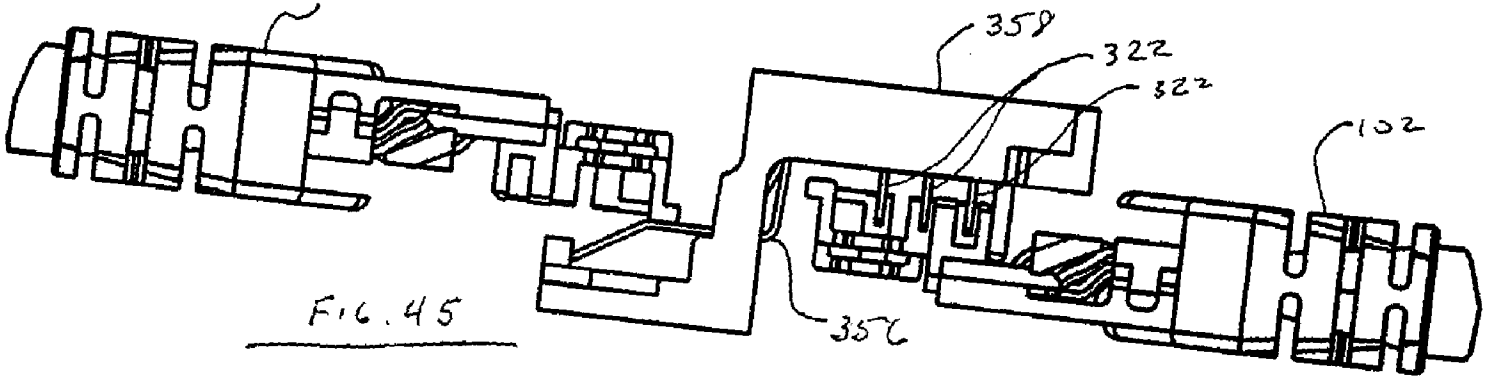
FIG. 45 is a cross-sectional view of the UCT to RJ45 adapter and UCT connectors of FIG. 44.

Referring to FIG. 39–41, in another embodiment UCT to UCT adapter 312 may utilize preformed contact springs 356. Note that in this embodiment UCT connector receiving portion 336 is rotated 180 degrees from the previous embodiment utilizing PCB bridge 350. This embodiment also includes jack insert 358 and jack housing 360.

Here preformed contact springs 314 include two sets of split tine contacts 324 joined by connecting portion 362. Termination caps 320 are structured and function in a similar fashion to that described above.

Referring to FIGS. 36*a*–36*e* the sequence of drawings depicts the insertion and termination of a UCT connector 102 in UCT connector receiving portion 336 of a UCT to RJ45 adapter 310.

Figures 30, 31, 32:
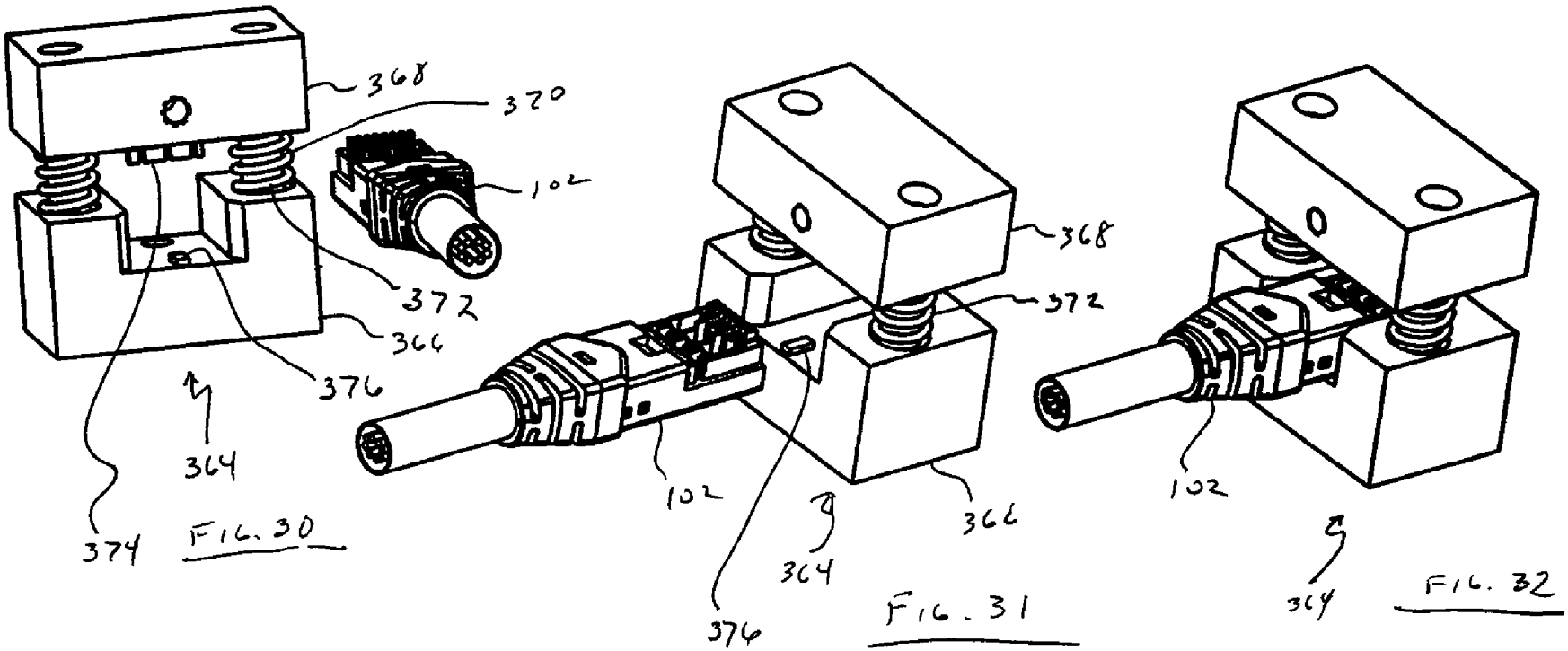
FIG. 30 is a perspective view of a termination contact setting tool and a UCT connector in accordance with the present invention.
FIG. 31 is another perspective view of the termination contact setting tool and a UCT connector.
FIG. 32 is a perspective view of a termination contact setting tool with the UCT connector inserted therein.

Referring to FIG. 30–32, network connection system 100 also includes termination contact setting tool 364. Termination contact setting tool 364 includes nest fixture 366, crimping head 368, guide pins 370, springs 372, and crimping blade 374. Crimping head 368 supports crimping blade 374 and is slidably engaged to guide pins 370. Springs 372 serve to reopen crimping head 368 relative to nest fixture 366 after it has been pressed shut.

Nest fixture 366 may support protruding post 376, which serves to align UCT connector 102 with termination contact setting tool 364.

FIGS. 42–45 depict the interconnection of UCT connectors 102 with two embodiments of UCT to RJ45 adapter 310. Certain parts of UCT connector 102 and UCT to RJ45 adapter 310 are removed for clarity.

Figure 46:
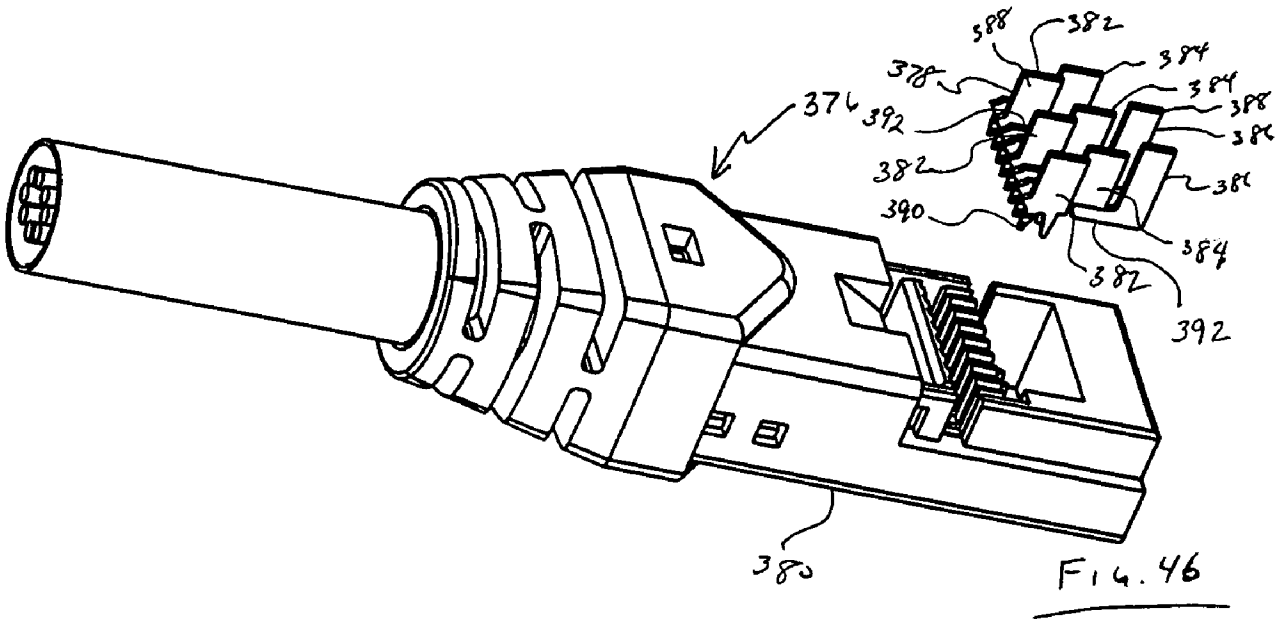
FIG. 46 is a partially exploded perspective view of an embodiment of the UCT connector having termination contact including a conductor engaging portion and a male portion engageable to a split tine contact.
Figure 47:
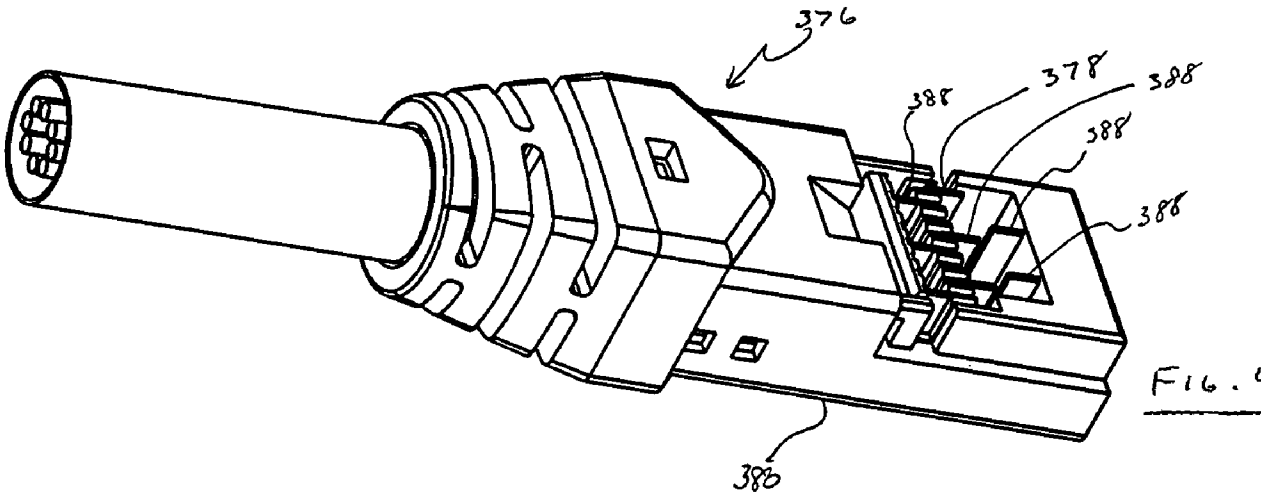
FIG. 47 is an assembled perspective view of the UCT connector depicted in claim 46.

Referring to FIGS. 46 and 47, connector 376 is depicted that is similar to UCT connector 102 is its general structure except that termination contacts 378 lack RJ45 contact 240 and connector housing 380 lacks slots 222 and other structures that accommodate RJ45 contacts 240.

Termination contacts 378 are of three types short contact 382, medium contacts 384 and long contacts 386. Termination contact s 378 include blade portion 388 and forked spear 390. Medium contacts 384 and long contacts 386 include mid-portion 392 interconnecting blade portion 388 and forked spear 390. In short contact 382, blade portion 388 is connected substantially directly to forked spear 390.

Blade portions 388 are dimensioned to be received into split tine contacts 322 in a fashion similar to that described above. Connector 376 is received into UCT connector receiving portion 336 is a similar fashion to that described above.

It is to be understood that Blade portions 388 and other described blade structures described herein are exemplary male connector structures and that pin like structures can be substituted or interchanged for them throughout this description. In addition, split tine contacts 322 are also exemplary and can be replaced with other female receiving contact structures such as in the case where pins are substituted for blades structures.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

We claim:

1. A network connection system for connecting computer and telephone network components, the network connection system comprising:

a twisted pair cable having multiple conductors in twisted pairs;

a port supporting a plurality of split tine contacts comprising two tines separated by a gap;

the port comprising a housing supporting the plurality of the split tine contacts and in which the male contact portions and the split tine contacts are arrayed in a pattern such that each male contact portion engages a corresponding split tine contact when the cable termination connector is connected to the port and a termination cap that is shiftable from an open position to a closed position and arranged such that when the termination cap is in the open position the cable termination connector can be inserted into the housing and when the termination cap is in the closed position the termination connector is held so that at least one male contact portion is conductively engaged to one of the split tine contacts; and a cable termination connector affixable at an end of the cable and releasably engageable to the port, the cable termination connector comprising:

a connector housing adapted for receiving at least a portion of the conductors; and a plurality of termination contacts locatable substantially within the connector housing, the termination contacts each comprising a conductor engaging portion to electrically engage one of the multiple conductors and a male contact portion, each male contact portion extending outwardly to be releasably engageable to one of the plurality of split tine contacts.

2. The network connection system as claimed in claim 1, at least some of the plurality of termination contacts further comprising an RJ connector engaging portion.

3. The network connection system as claimed in claim 1, in which the male contact portion comprises a blade portion releasably engageable to one of the split tine contacts.

4. The network connection system as claimed in claim 2, further comprising a cover releasably engagable to the cable termination connector.

5. A network connection system for connecting computer and telephone network components, the network connection system comprising:

a twisted pair cable having multiple conductors in twisted pairs;

a port supporting a plurality of split tine contacts comprising two tines separated by a gap; and a cable termination connector affixable at an end of the cable and releasably engageable to the port, the cable termination connector comprising:

a connector housing adapted for receiving at least a portion of the conductors; and a plurality of termination contacts locatable substantially within the connector housing, the termination contacts each comprising a conductor engaging portion to electrically engage one of the multiple conductors and a male contact portion, each male contact portion extending outwardly to be releasably engageable to one of the plurality of split tine contacts; and a cover releasably engagable to the cable termination connector, the cover comprising a latching arm and window slots, the window slots being substantially aligned with the RJ connector engaging portions when the cover is engaged to the cable termination connector to adapt the cable termination connector to connect to an RJ style port.

6. The network connection system as claimed in claim 4, the cover comprising a pull ring whereby the connector can be releasably attached to a pulling member.

7. The network connection system as claimed in claim 1, the housing further comprising a pair manager tray.

8. The network connection system as claimed in claim 7, in which the pair manager tray defines a plurality of substantially parallel troughs, each trough being dimensioned to accommodate one of the conductors.

9. The network connection system as claimed in claim 7, further comprising a pair manager cap.

10. A network connection system for connecting computer and telephone network components, the network connection system comprising:

a twisted pair cable having multiple conductors in twisted pairs;

a port supporting a plurality of split tine contacts comprising two tines separated by a gap; and a cable termination connector affixable at an end of the cable and releasably engageable to the port, the cable termination connector comprising:

a connector housing adapted for receiving at least a portion of the conductors; and a plurality of termination contacts locatable substantially within the connector housing, the termination contacts each comprising a conductor engaging portion to electrically engage one of the multiple conductors and a male contact portion, each male contact portion extending outwardly to be releasably engageable to one of the plurality of split tine contacts; and a pair manager tray that defines a central channel, two adjacent channels flanking the central channel and a y-passage substantially adjacent the central channel, each of the central channel and the two adjacent channels being sized to receive one of the twisted pairs and the y-passage being configured to guide two conductors of a twisted pair.

11. A network connection system for connecting computer and telephone network components, the network connection system comprising:

a twisted pair cable having multiple conductors in twisted pairs;

a port supporting a plurality of split tine contacts comprising two tines separated by a gap; and a cable termination connector affixable at an end of the cable and releasably engageable to the port, the cable termination connector comprising a connector housing adapted for receiving at least a portion of the conductors; and a plurality of termination contacts locatable substantially within the connector housing, the termination contacts each comprising a conductor engaging portion to electrically engage one of the multiple conductors and a male contact portion, each male contact portion extending outwardly to be releasably engageable to one of the plurality of split tine contacts; and a pair manager cap that defines a plurality of substantially parallel troughs and a plurality of windows, each trough being dimensioned to accommodate one of the conductors and each window corresponding to and aligned with one of the plurality of troughs, through which windows the conductor engaging portions of each termination contact fits to make electrical contact with one of the conductors.

12. The network connection system as claimed in claim 6, further comprising a feeder strip, the feeder strip comprising a pull lug and a plurality of pull ring hooks arrayed along its length, the pull ring hooks being engageable to the pull rings.

13. The network connection system as claimed in claim 1, the port further comprising a printed circuit board bridge connected to at least one of the split tine contacts.

14. The network connection system as claimed in claim 1, the port further comprising cantilever beam contacts, each cantilever beam contact being in electrical communication with one of the split tine contacts.

15. A network connection system for connecting computer and telephone network components, the network connection system comprising:

a twisted pair cable having multiple conductors in twisted pairs;

a port supporting a plurality of split tine contacts comprising two tines separated by a gap and comprising a housing supporting the plurality of the split tine contacts and in which the male contact portions and the split tine contacts are arrayed in a pattern such that each male contact portion engages a corresponding split tine contact when the cable termination connector is connected to the port; and a female RJ jack having spring contacts, each spring contact being in electrical communication with one of the split tine contacts; and a cable termination connector affixable at an end of the cable and releasably engageable to the port, the cable termination connector comprising:

a connector housing adapted for receiving at least a portion of the conductors; and a plurality of termination contacts locatable substantially within the connector housing, the termination contacts each comprising a conductor engaging portion to electrically engage one of the multiple conductors and a male contact portion, each male contact portion extending outwardly to be releasably engageable to one of the plurality of split tine contacts.

16. The network connection system as claimed in claim 1, further comprising a strain relief boot engageable to the connector housing and to the cable.

17. The network connection system as claimed in claim 1, in which the male contact portions of the termination contacts are accessed from a side of the termination connector.

18. The network connection system as claimed in claim 1, in which the male contact portions of the termination contacts comprise blade shaped contacts.

19. The network connection system as claimed in claim 1, in which the split tine contacts comprise split tines defining a gap of selected width and a tapered entry.

20. The network connection system as claimed in claim 1, in which the termination contacts comprise midbridge portions that are intertwined, staggered or a combination of the foregoing to electrically compensate and control crosstalk between signal paths.

* * * * *